US007974846B2

(12) United States Patent
Tsuchinaga et al.

(10) Patent No.: US 7,974,846 B2
(45) Date of Patent: Jul. 5, 2011

(54) DATA EMBEDDING DEVICE AND DATA EXTRACTION DEVICE

(75) Inventors: Yoshiteru Tsuchinaga, Yokohama (JP); Yasuji Ota, Kawasaki (JP); Masanao Suzuki, Kawasaki (JP); Masakiyo Tanaka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1276 days.

(21) Appl. No.: 10/802,168

(22) Filed: Mar. 17, 2004

(65) Prior Publication Data

US 2005/0023343 A1 Feb. 3, 2005

(30) Foreign Application Priority Data

Jul. 31, 2003 (JP) ..... 2003-284306

(51) Int. Cl.
*G10L 21/00* (2006.01)

(52) U.S. Cl. ..... 704/272; 704/200; 704/219; 704/270; 704/256

(58) Field of Classification Search ..... 704/256, 704/270, 200, 219, 272
See application file for complete search history.

(56) References Cited

U.S. PATENT DOCUMENTS

| | | | | |
|---|---|---|---|---|
| 7,069,211 | B2 * | 6/2006 | Chiu et al. | 704/221 |
| 2003/0176934 | A1 * | 9/2003 | Gopalan et al. | 700/94 |
| 2004/0220803 | A1 * | 11/2004 | Chiu et al. | 704/214 |

FOREIGN PATENT DOCUMENTS

| | | |
|---|---|---|
| EP | 0 840 513 | 5/1998 |
| JP | 2003-099077 | 4/2000 |
| JP | 2001-5472 | 1/2001 |
| JP | 2002-175089 | 6/2002 |
| JP | 2002-258881 | 9/2002 |
| JP | 2003-526274 | 9/2003 |
| WO | WO 00/07303 | 2/2000 |
| WO | WO 01/39175 | 5/2001 |
| WO | 01/67671 | 9/2001 |
| WO | WO 03/047138 | 6/2003 |

OTHER PUBLICATIONS

Wu et al. "Fragile speech watermarking based on exponential scale quantization for tamper detection" , 07803-7402-9/02, 2002 IEEE, IV:3305-3308.*

Wu et al., "Fragile speech watermarking based on exponential scale quantization for temper detection", Acoustics, Speech , and Signal Processing, 2002, Proceeding IEEE international conference.*

Mitsuhiro Hatada et al. Digital Watermarking Based on Process of Speech Production. Proceedings of the SPIE—The International Society for Optical Engineering, vol. 4861, Jul. 29, 2002 XP002320416.

European Search Report dated Jun. 10, 2005.

Notice of Reason for Rejection dated Jan. 6, 2009, from the corresponding Japanese Application.

European Communication pursuant to Article 94(3) EPC dated Mar. 19, 2009, from the corresponding European Application.

Bernd Friedrichs. "Kanalcodierung", Springer, 1996, pp. 1-4.

* cited by examiner

*Primary Examiner* — Qi Han
(74) *Attorney, Agent, or Firm* — Katten Muchin Rosenman LLP

(57) ABSTRACT

A data embedding device for embedding data in a speech code obtained by encoding a speech in accordance with a speech encoding method based on a voice generation process of a human being, includes an embedding judgment unit, every speech code, judging whether or not data should be embedded in the speech code, and an embedding unit embedding data in two or more parameter codes of a plurality of parameter codes constituting the speech code for which it is judged by the embedding judgment unit that the data should be embedded.

6 Claims, 34 Drawing Sheets

PRIOR ART

PRIOR ART

PRIOR ART

PRIOR ART

PRIOR ART

WHEN DATA EXTRACTION IS IN OFF STATE (WHEN JUDGMENT PARAMETER IS EQUAL TO OR HIGHER THAN THRESHOLD)

WHEN DATA EXTRACTION IS IN ON STATE (WHEN JUDGMENT PARAMETER IS EQUAL TO OR LOWER THAN THRESHOLD)

FIG. 15A

TABLE 1: ITEMS OF G.729 SPEECH ENCODING METHOD

| | |
|---|---|
| TRANSMISSION RATE | 8kbit/sec |
| SAMPLING FREQUENCY | 8kHz |
| FRAME LENGTH | 10ms(80 SAMPLES) |
| SUB-FRAME LENGTH | 5ms(40 SAMPLES) |

FIG. 15B

TABLE 2: TRANSMISSION PARAMETERS OF G.729 SPEECH ENCODING METHOD AND BIT ASSIGNMENT

| TRANSMISSION PARAMETER | BIT ASSIGNMENT[BIT] |
|---|---|
| LSP CODE | 18 |
| PITCH LAG CODE | 13(8/5) |
| ALGEBRAIC CODE | 34(17/17) |
| GAIN CODE | 14(7+7) |
| PITCH PARITY | 1 |
| TOTAL | 80[80BIT/FRAME] |

NOTE: ( )CONTENTS IN PARENTHESES REPRESENT BIT ASSIGNMENT FOR EACH SUB-FRAME

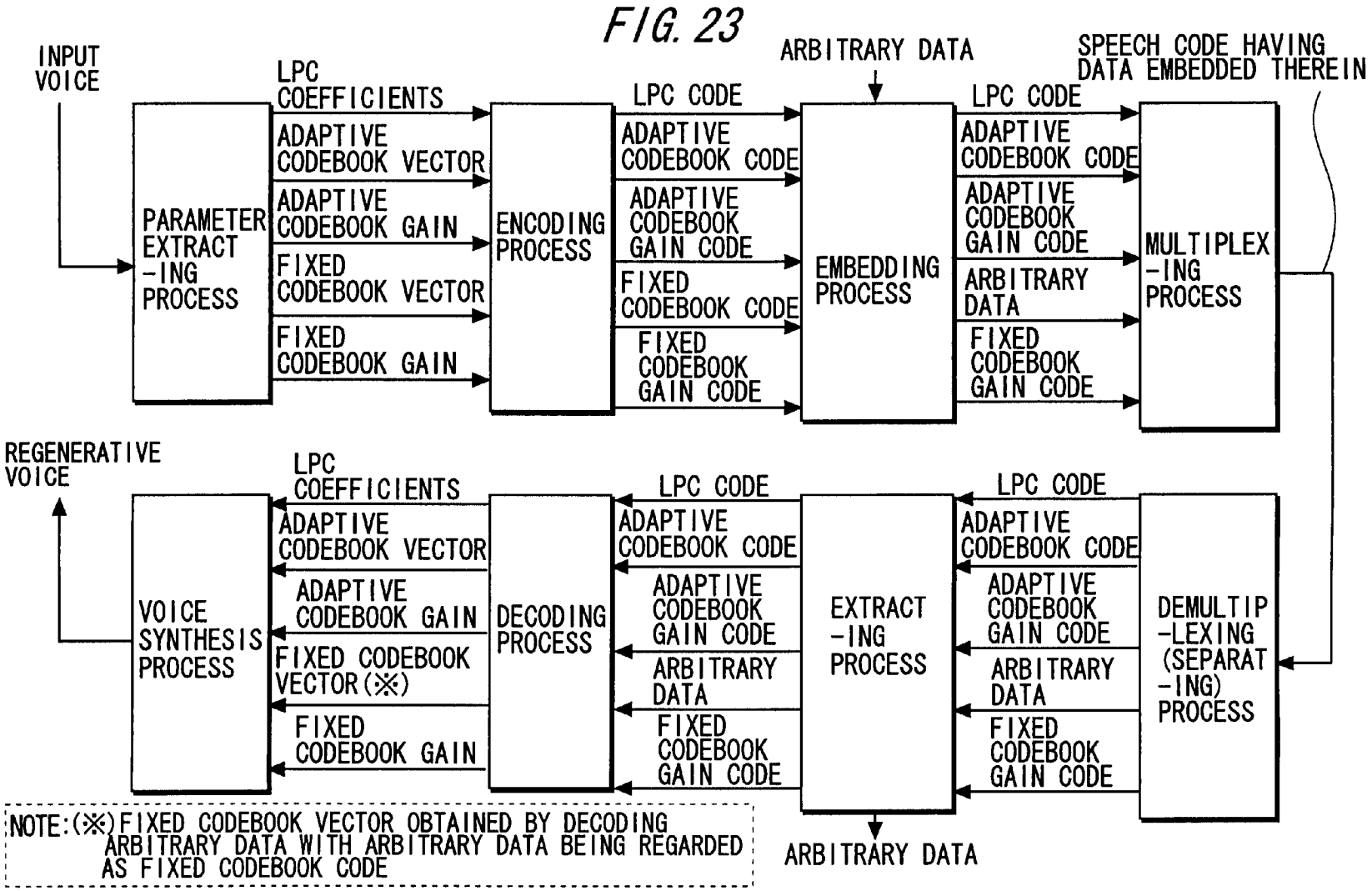
FIG. 23
INPUT VOICE
PARAMETER EXTRACT -ING PROCESS
LPC COEFFICIENTS
ADAPTIVE CODEBOOK VECTOR
ADAPTIVE CODEBOOK GAIN
FIXED CODEBOOK VECTOR
FIXED CODEBOOK GAIN
ENCODING PROCESS
LPC CODE
ADAPTIVE CODEBOOK CODE
ADAPTIVE CODEBOOK GAIN CODE
FIXED CODEBOOK CODE
FIXED CODEBOOK GAIN CODE
ARBITRARY DATA
EMBEDDING PROCESS
LPC CODE
ADAPTIVE CODEBOOK CODE
ADAPTIVE CODEBOOK GAIN CODE
ARBITRARY DATA
FIXED CODEBOOK GAIN CODE
SPEECH CODE HAVING DATA EMBEDDED THEREIN
MULTIPLEX -ING PROCESS
LPC CODE
ADAPTIVE CODEBOOK CODE
ADAPTIVE CODEBOOK GAIN CODE
ARBITRARY DATA
FIXED CODEBOOK GAIN CODE
DEMULTIP -LEXING (SEPARAT -ING) PROCESS
LPC CODE
ADAPTIVE CODEBOOK CODE
ADAPTIVE CODEBOOK GAIN CODE
ARBITRARY DATA
FIXED CODEBOOK GAIN CODE
EXTRACT -ING PROCESS
ARBITRARY DATA
LPC CODE
ADAPTIVE CODEBOOK CODE
ADAPTIVE CODEBOOK GAIN CODE
ARBITRARY DATA
FIXED CODEBOOK GAIN CODE
DECODING PROCESS
LPC COEFFICIENTS
ADAPTIVE CODEBOOK VECTOR
ADAPTIVE CODEBOOK GAIN
FIXED CODEBOOK VECTOR (※)
FIXED CODEBOOK GAIN
VOICE SYNTHESIS PROCESS
REGENERATIVE VOICE
NOTE: (※) FIXED CODEBOOK VECTOR OBTAINED BY DECODING ARBITRARY DATA WITH ARBITRARY DATA BEING REGARDED AS FIXED CODEBOOK CODE

FIG. 24A

CONFORMITY TO STANDARD FORMAT

| ENCODING RESULTS | LPC | ADAPTIVE CODEBOOK CODE | ADAPTIVE CODEBOOK GAIN | FIXED CODEBOOK CODE | FIXED CODEBOOK GAIN |
|---|---|---|---|---|---|
| | | | | (EMBEDDING OBJECT PARAMETER) | (EMBEDDING JUDGMENT PARAMETER) |

FIG. 24B

| TRANSMISSION CODES | LPC | ADAPTIVE CODEBOOK CODE | ADAPTIVE CODEBOOK GAIN | FIXED CODEBOOK CODE | FIXED CODEBOOK GAIN |
|---|---|---|---|---|---|

NOTE: WHEN JUDGMENT PARAMETER (FIXED CODEBOOK GAIN) IS HIGHER THAN THRESHOLD
→SPEECH CODE IS TRANSMITTED AS IT IS

FIG. 24C

| TRANSMISSION CODES | LPC | ADAPTIVE CODEBOOK CODE | ADAPTIVE CODEBOOK GAIN | EMBEDDED DATA (ARBITRARY) | FIXED CODEBOOK GAIN |
|---|---|---|---|---|---|

NOTE: WHEN JUDGMENT PARAMETER (FIXED CODEBOOK GAIN) IS EQUAL TO OR LOWER THAN THRESHOLD
→VOICE CODE IS TRANSMITTED AFTER OTHER DATA IS EMBEDDED IN OBJECT PARAMETER (FIXED CODEBOOK CODE)

FIG. 25A

CONFORMITY TO STANDARD FORMAT

| RECEIVED CODES | LPC | ADAPTIVE CODEBOOK CODE | ADAPTIVE CODEBOOK GAIN | ? | FIXED CODEBOOK GAIN |
|---|---|---|---|---|---|
| | | | | (EMBEDDING OBJECT PARAMETER) | (EMBEDDING JUDGMENT PARAMETER) |

FIG. 25B

| JUDGMENT RESULTS | LPC | ADAPTIVE CODEBOOK CODE | ADAPTIVE CODEBOOK GAIN | FIXED CODEBOOK CODE | FIXED CODEBOOK GAIN |
|---|---|---|---|---|---|

NOTE: WHEN JUDGMENT PARAMETER (FIXED CODEBOOK GAIN) IS HIGHER THAN THRESHOLD
→SPEECH CODE IS TRANSMITTED AS IT IS

FIG. 25C

| JUDGMENT RESULTS | LPC | ADAPTIVE CODEBOOK CODE | ADAPTIVE CODEBOOK GAIN | EMBEDDED DATA (ARBITRARY) | FIXED CODEBOOK GAIN |
|---|---|---|---|---|---|

NOTE: WHEN JUDGMENT PARAMETER (FIXED CODEBOOK GAIN) IS EQUAL TO OR LOWER THAN THRESHOLD
→EMBEDDED DATA IS DECODED IN FORM OF OBJECT PARAMETER (FIXED CODEBOOK CODE)
AFTER EMBEDDED DATA IS EXTRACTED FROM OBJECT PARAMETER (FIXED CODEBOOK CODE)

FIG. 26A

CONTINUOUS DISAPPEARANCE OF BLOCKS HAVING NUMBER SMALLER THAN $2^x$ BITS

| 00 | 01 | 10 | 11 | 00 | 01 | 10 | 11 | 00 | 01 | 10 | 11 | 00 | 01 |
|---|---|---|---|---|---|---|---|---|---|---|---|---|---|

DETECTION OF CONTINUOUS DISAPPEARANCE OF BLOCKS MAY BE POSSIBLE SINCE SEQUENCE NUMBERS ARE DISCONTINUOUS BEFORE AND AFTER DISAPPEARANCE OF BLOCKS

FIG. 26B

CONTINUOUS DISAPPEARANCE OF BLOCKS HAVING NUMBER EQUAL TO 2 BITS

| 00 | 01 | 10 | 11 | 00 | 01 | 10 | 11 | 00 | 01 | 10 | 11 | 00 | 01 |
|---|---|---|---|---|---|---|---|---|---|---|---|---|---|

DETECTION OF CONTINUOUS DISAPPEARANCE OF BLOCKS IS IMPOSSIBLE SINCE CONTINUITY OF SEQUENCE NUMBERS ARE HELD BEFORE AND AFTER DISAPPEARANCE OF BLOCKS

FIG. 26C

CONTINUOUS DISAPPEARANCE OF BLOCKS HAVING NUMBER EQUAL TO OR LARGER THAN $(2^x + 1)$ BITS

| 00 | 01 | 10 | 11 | 00 | 01 | 10 | 11 | 00 | 01 | 10 | 11 | 00 | 01 |
|---|---|---|---|---|---|---|---|---|---|---|---|---|---|

DETECTION OF CONTINUOUS DISAPPEARANCE OF BLOCKS IS POSSIBLE SINCE SEQUENCE NUMBERS ARE DISCONTINUOUS BEFORE AND AFTER DISAPPEARANCE OF BLOCKS HOWEVER, SINCE CONNECTION OF NUMBERS IS SAME AS THAT IN FIG. 26A⇒THERE IS POSSIBILITY THAT NUMBER OF DISAPPEARED BLOCKS IS COUNTED BY MISTAKE

DATA EMBEDDING DEVICE AND DATA EXTRACTION DEVICE

BACKGROUND OF THE INVENTION

The present invention relates to a data embedding technique for embedding an objective data to be embedded in data, and a data extraction technique for extracting an objective data to be embedded from data.

For example, the present invention relates in general to a digital voice (speech) signal processing technique including packet voice communication or digital voice storage as an application field with the explosive growth of the Internet in the background. More particularly, the invention relates to a data embedding technique for replacing a part of digital codes compressed by utilizing a speech encoding technique with arbitrary data without deteriorating voice quality while holding conformity to the standard of a data format.

In recent years, while computers and the Internet become widespread, "a digital watermarking technique" for embedding a special data in multi-media contents (such as a still picture, a moving picture, an audio, or a voice) has attracted public attraction. Such a technique, for the purpose of mainly protecting a copyright, is used to embed a name of a producer, a salesperson or the like in contents in order to prevent unlawful copy or revision of data. In addition thereto, such a technique is used for the purpose of embedding related information or additional information concerned with contents in order to enhance convenience during utilization of contents by a user.

In a field of voice communication as well, there is made an attempt to embed such arbitrary information in a voice to transmit or store the resultant information. A conceptual diagram is shown in FIG. 1. In FIG. 1, an encoder, when encoding an input voice into a speech code (voice code), embeds an arbitrary data sequence other than a voice in a speech code to transmit the resultant code to a decoder. At this time, the data is embedded in the speech code itself without changing a format of the speech code. For this reason, a quantity of information of the speech code is not increased. The decoder reads out the embedded arbitrary data sequence from the speech code, and outputs a regenerative voice after a normal processing for decoding a speech code has been executed.

With in the above-mentioned configuration, it becomes possible to transmit arbitrary data in addition to a voice without increasing a transmission quantity. In addition, a third person that is not aware of that the data is embedded merely recognizes the communication concerned as normal voice (speech) communication. As for a method including embedding data, various kinds of methods have been proposed.

As for the prior art concerned with the present invention, for example, there are techniques disclosed in the following patent documents 1 to 4. The patent document 1 is "JP 2003-99077 A", the patent document 2 is "JP 2002-521739 A", the patent document 3 is "JP 2002-258881 A", and the patent document 4 is "WO 00/039175".

In the above-mentioned technique for embedding and extracting data in and from a speech code, it is desirable to embed much data in a speech code. In addition, it is also desirable that a voice quality is not degraded due to the embedding of data. Moreover, it is desirable that accurate embedded data is obtained on a decoding side.

It is one of objects of the present invention to provide a technique that is capable of increasing a transmission capacity of embedded data.

In addition, it is one of objects of the present invention to provide a technique that is capable of suppressing generation of voice quality degradation due to embedding of data.

Furthermore, it is one of objects of the present invention to provide a technique that is capable of obtaining accurate embedded data on a side of reception of data.

SUMMARY OF THE INVENTION

According to a first aspect of the first invention of the present invention, there is provided a data embedding device for embedding objective data to be embedded in a speech code obtained by encoding a voice in accordance with a speech encoding method based on a voice generation process of a human being, including:

an embedding judgment unit, every speech code, judging whether or not data should be embedded in the speech code; and an embedding unit embedding data in two or more parameter codes, defined as embedding object parameter codes, of a plurality of parameter codes constituting the speech code for which it is judged by the embedding judgment unit that the data should be embedded.

According to a second aspect of the first invention, there is provided a data extraction device for extracting data embedded in a speech code obtained by encoding a voice in accordance with a speech encoding method based on a voice generation process of a human being, including:

an extraction judgment unit, every speech code, judging whether or not data is being embedded in the speech code; and an extraction unit extracting data being embedded in two or more parameter codes, defined as embedding object parameter codes, of a plurality of parameter codes constituting the speech code for which it is judged by the extraction judgment unit that the data is being embedded.

According to a third aspect of the first invention, there is provided a data embedding/extraction device for executing a process for embedding data in a speech code and a process for extracting data from a speech code, including:

an embedding judgment unit, every speech code, judging whether or not the data should be embedded in the speech code;

an embedding unit embedding data in two or more parameter codes, defined as embedding object parameter codes, of a plurality of parameter codes constituting the speech code for which it is judged by the embedding judgment unit that the data should be embedded;

an extraction judgment unit, every speech code, judging whether or not data is being embedded in the speech code; and an extraction unit extracting data being embedded in two or more parameter codes, defined as embedding object codes, of a plurality of parameter codes constituting the speech code for which it is judged by the extraction judgment unit that data is being embedded.

In addition, the first invention can be specified as a data embedding method, a data extracting method, and a data embedding/extracting method, each of which has the same features as those of the first to third aspects.

According to a first aspect of a second invention, there is provided a data embedding device, including:

a generation unit generating error detection data for embedding data; and an embedding unit to embed the embedding data and the error detection data in other data.

A second aspect in the second invention is a data embedding device, including:

a generation unit generating error detection data for embedded data;

a block assembling unit assembling a data block including the embedded data and the error detection data; and an embedding unit embedding the data block in other data.

According to a third aspect of the second invention, there is provided a data transmission device, including:

a generation unit generating error detection data for embedded data;

an embedding unit embedding the embedded data and the error detection data in other data; and a unit transmitting the other data having the embedded data and the error detection data to a data reception device through a network.

In the second invention, the embedding unit can be configured so as to embed the embedded data and the error detection data (error detection signal) in other data (data sequence) either in data blocks (large blocks) each structured (assembled) from the embedded data and the error detection data, or in division blocks (small blocks) into a predetermined number of which the data block (large block) is divided. The data sequence, for example, is a speech code into which a voice is encoded in accordance with a speech encoding method, and each division block, for example, is embedded in a speech code for one frame.

According to a fourth aspect of the second invention, there is provided a data extraction device, including:

a unit extracting embedded data and error detection data which are embedded in data received from a data transmission device through a network;

a checking unit checking on the presence or absence of an error in the embedded data by using the embedded data and the error detection data; and a unit, when it is judged as a result of the check by the checking unit that there is no error in the data as an object for embedding, outputting the embedded data, and, when it is judged as a result of the check by the checking unit that there is an error in the data concerned as an object for embedding, outputting data for transmitting a resending request of the embedded data to the data transmission device.

According to a fifth aspect of the second invention, there is provided a data extraction device, including:

a unit extracting embedded data and error detection data for the embedded data that are embedded in data received from a data transmission device through a network;

a restoration unit restoring a data block including therein the embedded data, and the error detection data;

a checking unit checking on whether there is an error in the embedded data or not by use of the embedded data and the error detection data which are included in the restored data block; and an unit, when it is judged as a result of the check by the checking unit that there is no error in the embedded data, outputting the embedded data, and outputting, when it is judged as a result of the check by the checking unit that there is an error in the embedded data, data used to transmit a resending request of the embedded data to the data transmission device.

According a sixth aspect of the second invention, there is provided a data extraction device, including:

an extraction unit extracting a first data block embedded in data received from a data transmission device through a network;

a restoration unit combining a plurality of first data blocks respectively extracted by the extraction unit to restore a second data block including therein the embedded data and the error detection data;

a checking unit checking whether there is an error in the embedded data or not by use of the embedded data and the error detection data which are included in the restored second data block; and an unit, when it is judged as a result of the check by the checking unit that there is no error in the embedded data, outputting the embedded data, and, when it is judged as a result of the check by the checking unit that there is an error in the embedded data, outputting data used to transmit a resending request to resend the embedded data to the data transmission device.

According a seventh aspect of the second invention, there is provided a data reception device, including:

a unit receiving data from a data transmission device through a network;

an unit extracting data as an object for embedding, and data for error detection for the data as an object for embedding which are embedded in data received from a data transmission device through a network;

a checking unit checking on the presence or absence of an error in the extracted data as an object for embedding using the data concerned as an object for embedding, and the extracted data for error detection; and an unit, when it is judged as a result of the check by the checking unit that there is no error in the data as an object for embedding, outputting the data concerned as an object for embedding, and, when it is judged as a result of the check by the checking unit that there is an error in the data concerned as an object for embedding; transmitting a resending request to resend the data concerned as an object for embedding to the data transmission device.

According an eighth aspect of the second invention, there is provided a communication device, including:

a generation unit generating data for error detection for data as an object for embedding;

an embedding unit embedding the data as an object for embedding and the data for error detection in other data;

a unit transmitting the other data to a device which is to receive the other data through a network;

a unit receiving the data through the network;

a unit extracting the data as an object for embedding, and the data for error detection for the data as an object for embedding which are embedded in the received data;

a checking unit checking on the presence or absence of an error in the data as an object for embedding using the data as an object for embedding and the data for error detection which are extracted; and a unit, when it is judged as a result of the check by the check means that there is no error in the data as an object for embedding, outputting the data as an object for embedding, and, when it is judged as a result of the check by the check means that there is an error in the data as an object for embedding, outputting data used to transmit a resending request to resend the data as an object for embedding to an device as a source of the data, in which the embedding unit receives the data used to transmit the resending request to embed a predetermined resending request in the other data.

In addition, the second invention can be specified as the invention of a method having the same features as those of the invention of the above-mentioned device.

According to the present invention, it is possible to increase a transmission capacity of embedded data.

In addition, according to the present invention, it is possible to suppress generation of voice degradation due to embedding of data.

Also, according to the present invention, accurate embedded data can be obtained on a side of reception of data.

BRIEF DESCRIPTION OF THE DRAWINGS

FIGS. 15A and 15B are diagrams useful in explaining the G.729 method;

FIG. 23 is a diagram showing a flow of a data embedding/extraction processing in the basic technique;

FIGS. 24A to 24C are conceptual diagrams of data embedding in the basic technique;

FIGS. 25A to 25C are conceptual diagrams of data extraction in the basic technique;

FIGS. 26A to 26C are diagrams showing an example of error detection using a sequence number;

DESCRIPTION OF PREFERRED EMBODIMENTS

The best mode for carrying out the invention will hereinafter be described with reference to the accompanying drawings. A configuration of the following embodiment mode is merely an exemplification, and the present invention is not intended to be limited to the configuration of the embodiment mode.

[First Invention]

First of all, a data embedding and extraction technique according to a first invention of the present invention will be described.

<Circumferences of First Invention>

As one of voice encoding methods that have been the main current in recent years, there is a CELP (Code Excited Linear Prediction) method. As for a method including embedding arbitrary information in a speech code obtained by encoding a voice in accordance with the CELP method, there is a technique concerned with data embedding and extraction which was already filed as a patent application by the applicant of the present invention (Japanese Patent Application No. 2002-26958 (hereinafter referred to as "a basic technique"). The features of the basic technique areas follows. (1) Arbitrary data can be embedded without changing a format of encoded data. (2) Arbitrary data can be embedded while suppressing any of influences on quality of regenerative voice (3) A quantity of embedded data can be adjusted while taking an influence on quality of regenerative voice into consideration. (4) This technique can be applied to various methods without being limited to a specific method as long as those methods are the CELP based methods.

Figure 2:
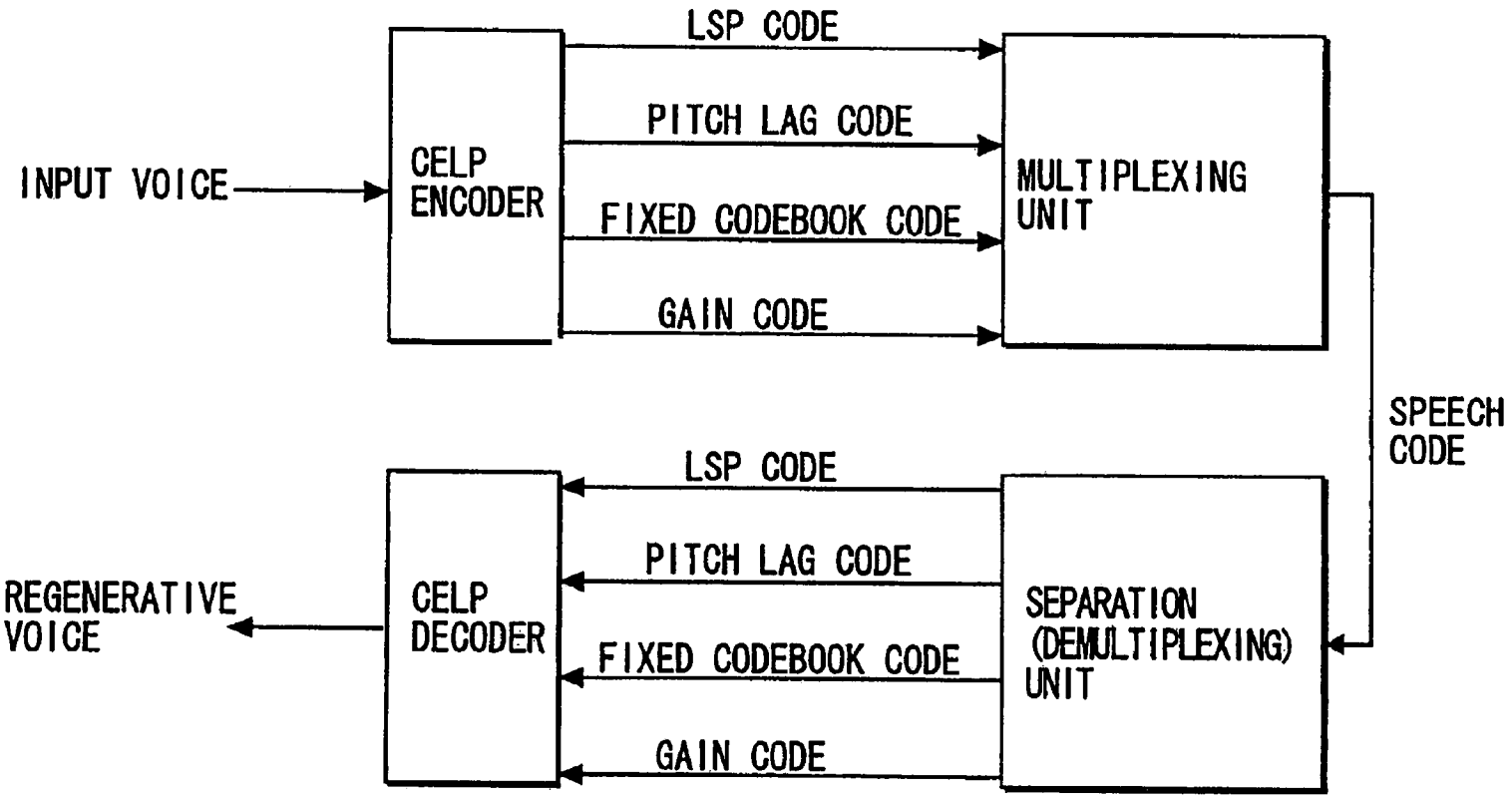
FIG. 2 is a diagram showing a flow of an encoding/decoding processing conforming to a CELP speech encoding method.

The basic technique will herein below be described. First of all, the CELP method as the fundamental technique of the basic technique will now be described. FIG. 2 is a diagram showing a processing outline of the basic technique (a flow of an encoding/decoding processing in a CELP speech encoding method). The CELP method is a highly compressed speech encoding technique for extracting parameters from an input voice to transmit the extracted parameters on the basis of an analysis based on a voice generation model of a human being. A speech encoding method such as an ITU-T G.729 method or a 3GPP AMR method which is adopted in a recent communication system such as a digital mobile phone or an Internet phone is a CELP-based method.

In FIG. 2, an encoder includes a CELP encoder and a multiplexing unit. The CELP encoder serves to encode an input voice to obtain a plurality of parameter codes (an LSP code, a pitch lag code, a fixed codebook code, and a gain code). The multiplexing unit serves to multiplex a plurality of parameter codes outputted from the CELP encoder to output the multiplexed codes in the form of a speech code. A decoder includes a separation unit and a CELP decoder. The separation unit serves to separate the speech code outputted from the encoder into a plurality of parameter codes. The CELP decoder serves to decode the parameter codes obtained through the separation process in the separation unit and to reproduce a voice.

Figure 3:
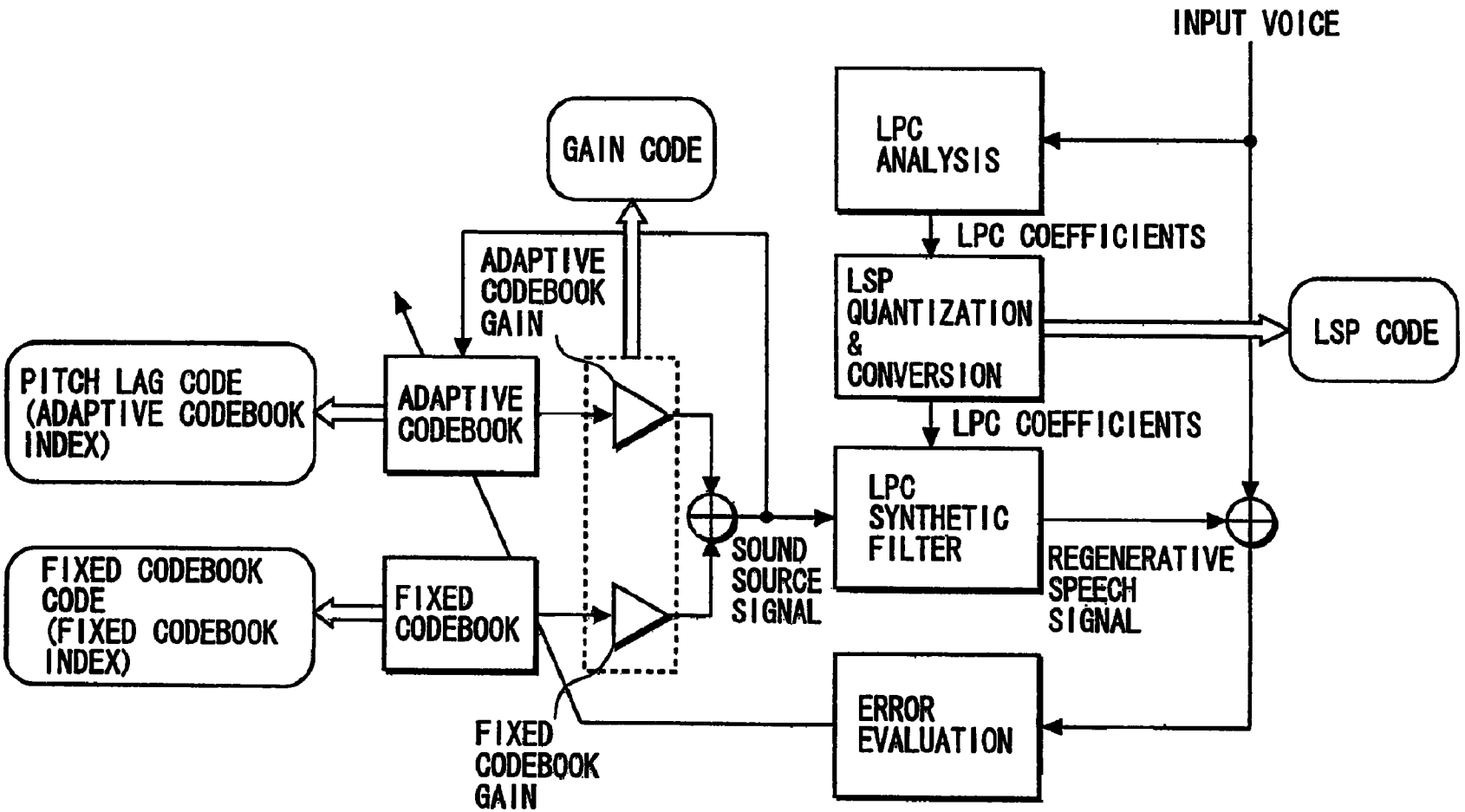
FIG. 3 is a block diagram of an encoder conforming to the CELP method.

FIG. 3 is a block diagram showing an example of a configuration of the CELP encoder. The CELP encoder encodes an input signal (input voice) in frames each having a fixed length. First of all, the CELP encoder subjects the input signal to a linear prediction analysis (LPC analysis) to obtain a linear prediction coefficient (LPC coefficient). The LPC coefficient is a coefficient that is obtained by approximating vocal tract characteristics in an utterance of a human being using an all poll type linear filter. This information is normally converted into an LSP (Linear Spectrum Pair) or the like to be quantized.

Next, the CELP encoder extracts a sound source signal. In the CELP method, the sound source signal is inputted to an LPC synthetic filter having an LPC coefficient to thereby generate a regenerative voice. Thus, the CELP encoder carries out extraction of the sound source signal by searching for an optimal sequence (sound source vector) at which an error between a regenerative voice obtained by passing through the LPC synthesis filter and an input voice becomes minimum among a plurality of sound source candidates stored in a codebook.

Figure 4:
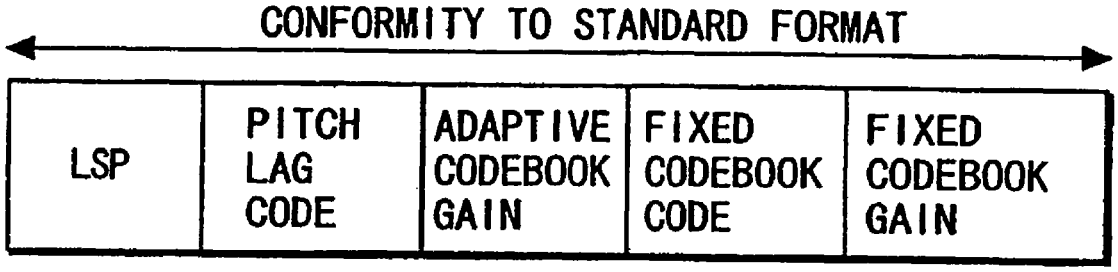
FIG. 4 is a diagram of a structure of a speech code conforming to the CELP method.

The selected sound source signal is then transmitted in the form of an index of a codebook representing a place where the selected sound source signal is stored. In the usual way, the codebook is composed of two kinds of codebooks, i.e., an adaptive codebook for expressing periodicity (pitch) of a sound source, and a fixed codebook (noise codebook) for expressing a noise component of a sound source. In this case, an index (pitch lag code) of the adaptive codebook, and an index (fixed codebook code) of the fixed codebook are obtained as parameter codes, respectively. At this time, gains (gain codes (an adaptive codebook gain and a fixed codebook gain) for adjustment of amplitude of each sound source vector are also obtained as parameter codes, respectively. The parameter codes thus extracted are multiplexed in a multiplying unit into one code in the form conforming to a standard format as shown in FIG. 4 to be transmitted as a speech code to the decoder.

Figure 5:
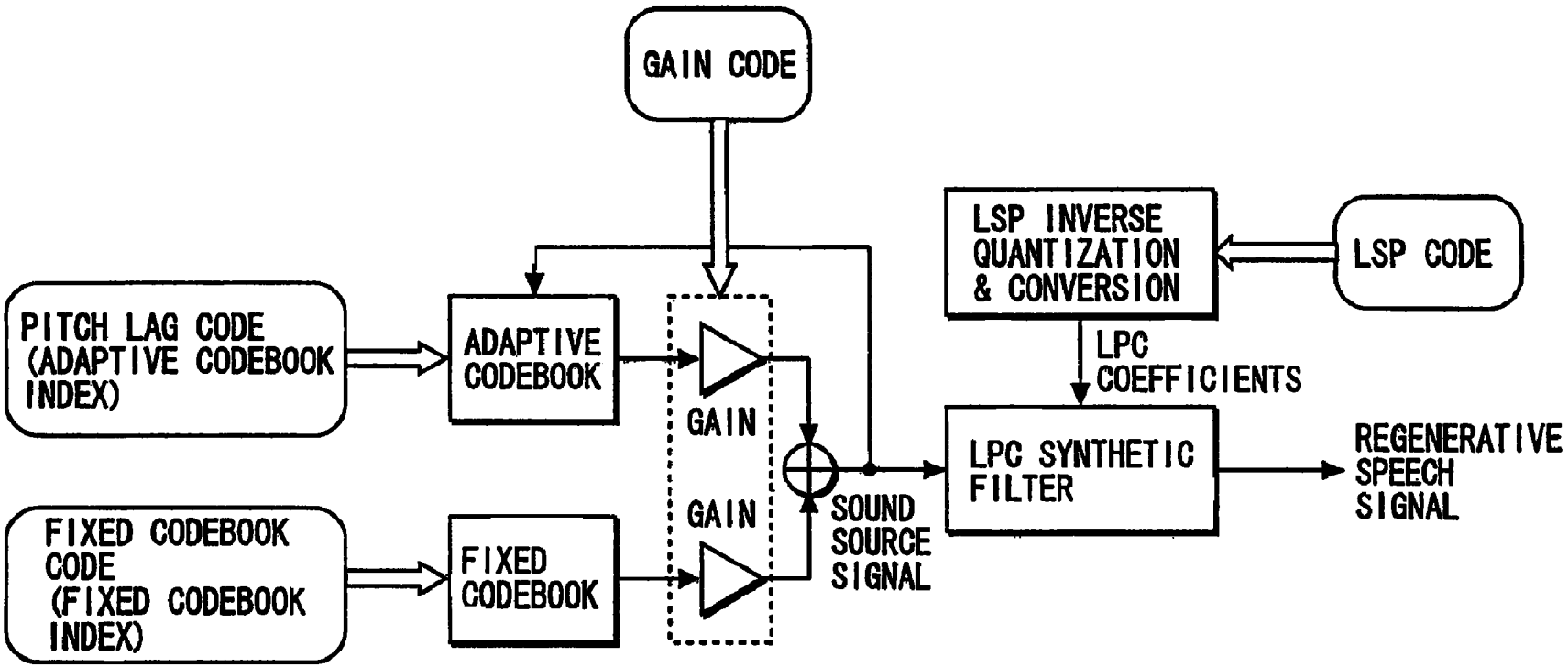
FIG. 5 is a block diagram of a decoder conforming to the CELP method.

On the other hand, on a side of the decoder, the speech code transmitted to the decoder is separated into the parameters to generate a regenerative voice based on these parameters. FIG. 5 is a block diagram showing an example of a configuration of the CELP decoder. The CELP decoder reproduces a voice through a processing obtained by copying a voice generation system. More specifically, the decoder generates a sound source signal on the basis of an index specifying a sound source sequence (a pitch lag code and a fixed codebook), and gain information (gain code).

Then, the CELP decoder generates (reproduces) a voice by causing a sound source signal to pass through the LPC synthetic filter having the linear prediction coefficient (LPC coefficient). That is to say, the LPC synthetic filter subjects the inputted sound source signal to a filtering processing using the LPC coefficient obtained by decoding the LPC code to output a signal passed through the filter in the form of a regenerative signal. Such a processing is expressed by the following Expression <1>.

$$Srp=HR=H(g_pP+g_cC) \quad <1>$$

In the Expression <1>, the character "Srp" is the regenerative signal, the character "R" is the sound source signal, the character "H" is the LPC synthetic filter, the character "$g_p$" is the adaptive code word gain, the character "P" is the adaptive code word, the character "$g_c$" is the fixed code word gain, and the character "C" is the fixed code word.

Figure 6:
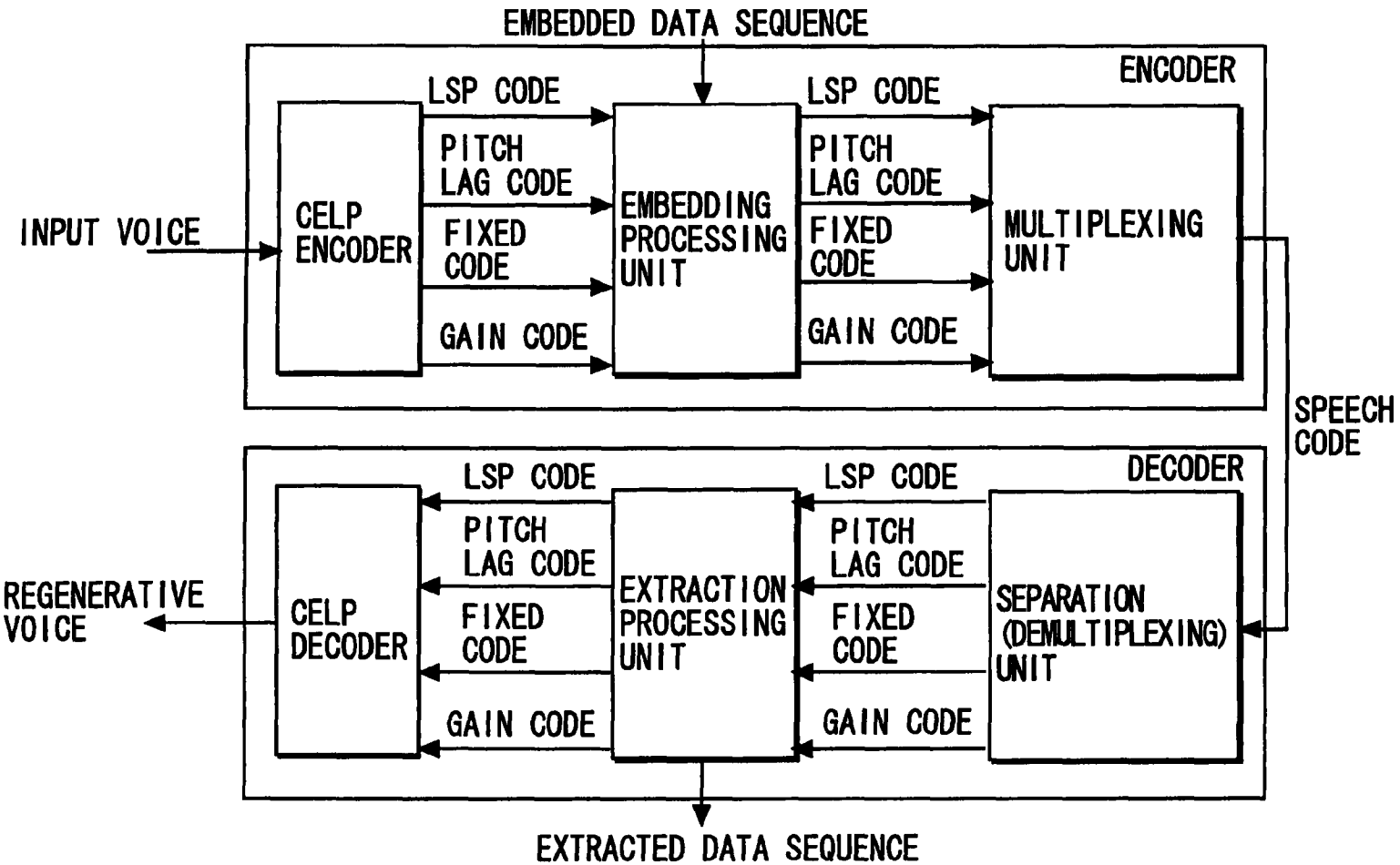
FIG. 6 is a diagrams showing a flow of an encoding/decoding processing conforming to the CELP method to which data embedding is applied.

Next, a description will be given with respect to the processing for embedding/extracting data in the basic technique. FIG. 6 is a diagram showing a basic processing concept of the encoding/decoding processing according to the CELP method to which the data embedding processing is applied. As shown in FIG. 6, an embedding processing unit provided on a side of the encoder, and an extraction processing unit provided on a side of the decoder carry out embedding and extraction of data with the transmission parameters contained in the speech code as an object, respectively.

That is to say, the embedding processing unit embeds data as an object for embedding in the specific parameter code of a plurality of parameter codes outputted from the CELP encoder. Thereafter, the multiplexing unit (multiplexer) multiplexes a plurality of parameter codes containing therein the parameter code having the data embedded therein to output the resultant code in the form of a speech code having the data embedded therein. The speech code is then transmitted to the side of the decoder.

On the side of the decoder, a separation unit (demultiplexer) separates the speech code into a plurality of parameter codes. The extraction processing unit extracts the data embedded in the specific parameter code of a plurality of parameter codes. Thereafter, a plurality of parameter codes are inputted to the CELP decoder, and the CELP decoder then decodes a plurality of parameter codes to reproduce a voice.

Next, the embedding processing unit and the extraction processing unit will be described. As described above, a digital code (parameter code) obtained by encoding the input voice in the CELP encoder corresponds to a feature parameter of the voice generation system. Focusing attention to this feature, a state of each parameter can be grasped.

Focusing attention on two kinds of code words of the sound source signal, i.e., an adaptive code word corresponding to a pitch sound source, and a fixed code word corresponding to a noise sound source, gains corresponding to these code words can be regarded as factors exhibiting degrees of contribution of the code words, respectively. In other words, when a gain is small, the degree of contribution of the code word corresponding to this gain becomes small.

Then, the gains corresponding to the sound source code words are defined as judgment parameters. Then, since when a gain becomes equal to or lower than a certain threshold, the degree of contribution of the corresponding sound source code word is small, the embedding processing unit replaces an index (a pitch lag code or a fixed codebook code) of that sound source code word with an arbitrary data sequence as an object for embedding as an embedding object parameter. In such a manner, the processing for embedding data is executed. As a result, an influence exerted on voice quality due to the replacement (embedding) of data can be suppressed to a low level. In addition, a threshold is controlled, whereby a quantity of embedded data can be adjusted while taking an influence exerted on quality of regenerative voice into consideration.

In addition, in accordance with the above-mentioned technique, if only an initial value of the threshold is previously defined on both the side of the encoder and the side of the decoder, then judgment of the presence or absence of embedded data, specification of a place where data is embedded, and write/read of embedded data become possible using only the judgment parameters and the embedding object parameters. Moreover, if a control code (e.g., change of a threshold) is defined in data as an object for embedding, even if additional information (control code) is not transmitted through a different path, change of a threshold, or the like can be carried out, and a transmission quantity of embedded data can be adjusted.

FIGS. 7A and 7B, and FIGS. 8A and 8B are diagrams useful in explaining a concept of the processing for embedding/extracting data when the fixed codebook gain is regulated as the judgment parameter, and also the fixed codebook index (fixed codebook code) is regulated as the embedding object parameter.

Figure 7A:
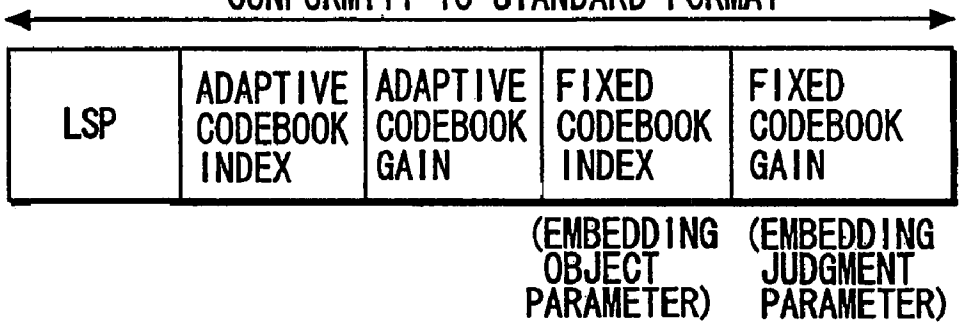
FIGS. 7A and 7B are conceptual diagram of embedding of data in a speech code.
Figure 7B:
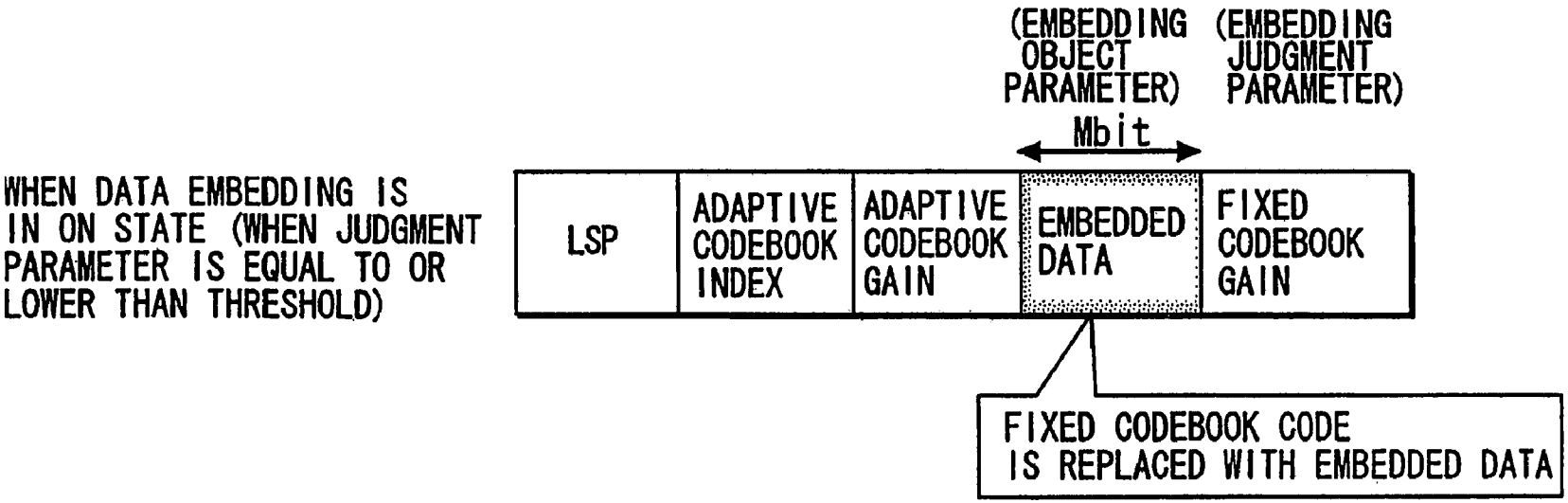
Figure 8A:
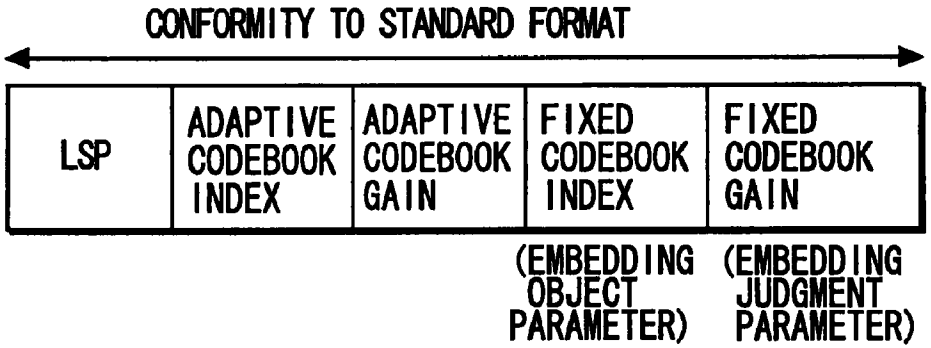
FIGS. 8A and 8B are conceptual diagrams of extraction of embedded data from a speech code.
Figure 8B:
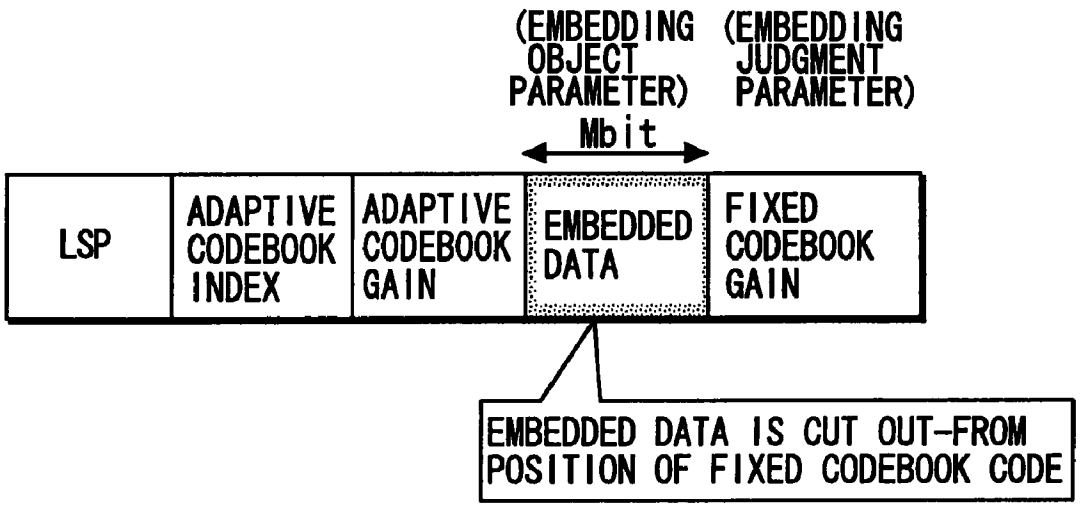

As shown in FIGS. 7A and 7B, the processing for embedding data in a speech code is executed by replacing M (M is a natural number) bits of a parameter code as an object for embedding with M bits of an arbitrary data sequence. On the other hand, as shown in FIGS. 8A and 8B, the processing for extracting data, conversely to the processing for embedding data, is executed by cutting out M bits of the embedding object parameter. Note that, the cut-out arbitrary data sequence is then inputted as one of parameters to the decoder.

Figure 9:
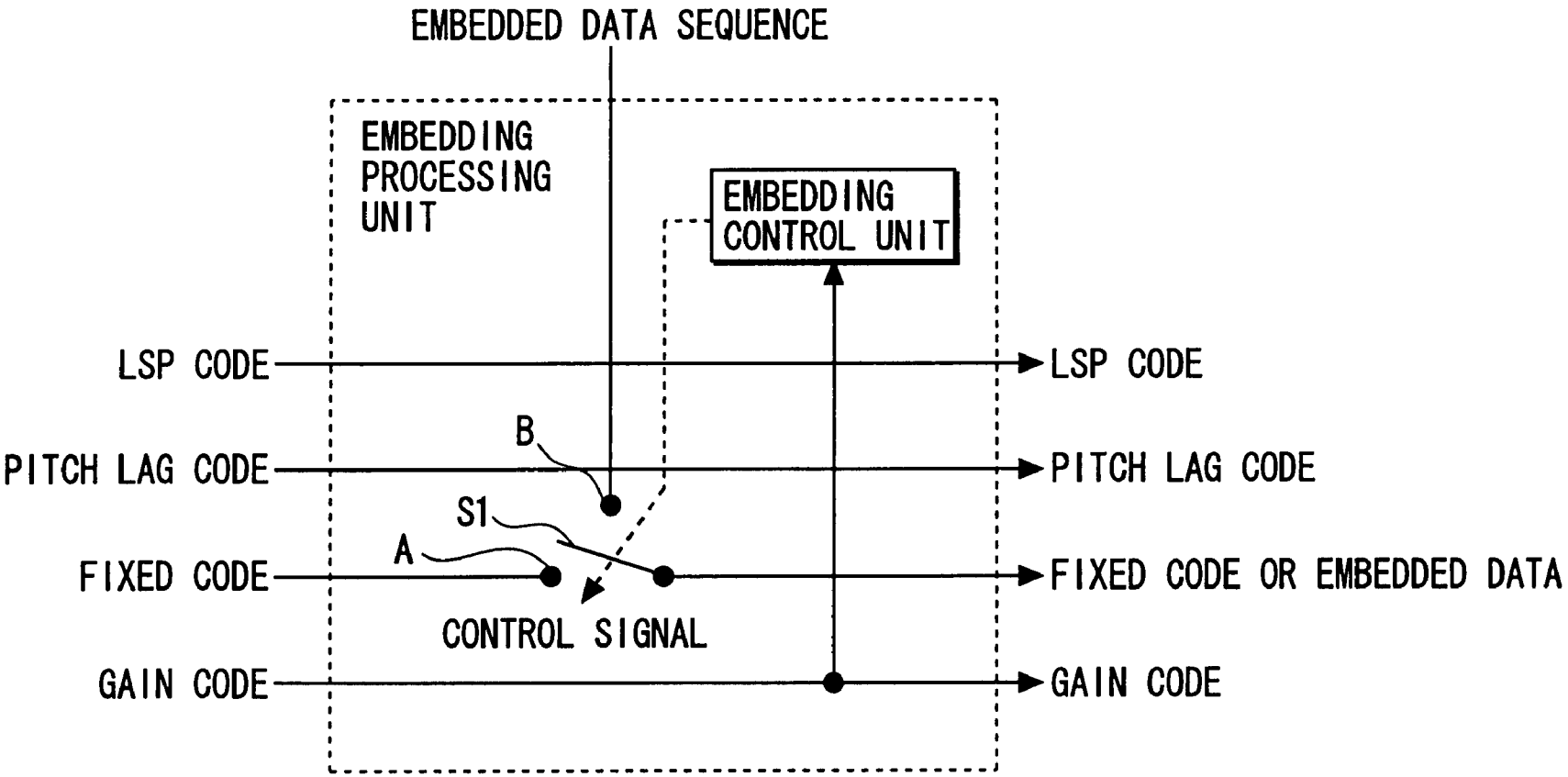
FIG. 9 is a diagram showing an example of a configuration of a data embedding processing unit.

FIG. 9 is a block diagram showing an example of a configuration of the data embedding processing unit. As shown in FIG. 9, an LSP code, a pitch lag code, a fixed code, and a gain code are inputted from the CELP encoder to the embedding processing unit. The embedding processing unit has an embedding control unit and a switch S1. The embedding control unit is configured so as to receive as its input the gain code as a control parameter (judgment parameter). The embedding control unit judges whether or not a gain exceeds a predetermined threshold to give the switch S1 a control signal based on judgment results. As a result, the embedding control unit changes a contact of the switch S1 over to one of a side of the fixed code (an end point A) and a side of the embedded data (an end point B).

That is to say, the embedding control unit, when the gain exceeds the predetermined threshold, selects the end point A to output the fixed code. On the other hand, the embedding control unit, when the gain does not exceed the predetermined threshold, selects the end point B to output the embedded data sequence. In such a manner, the embedding control unit carries out change-over of the switch S1 to perform the control so as to judge whether or not the parameter code (fixed code) as an object for embedding should be replaced with arbitrary data. Consequently, when the embedding processing is in an OFF state, no replacement of data is carried out, and hence the parameter code is outputted in its entirety.

Figure 10:
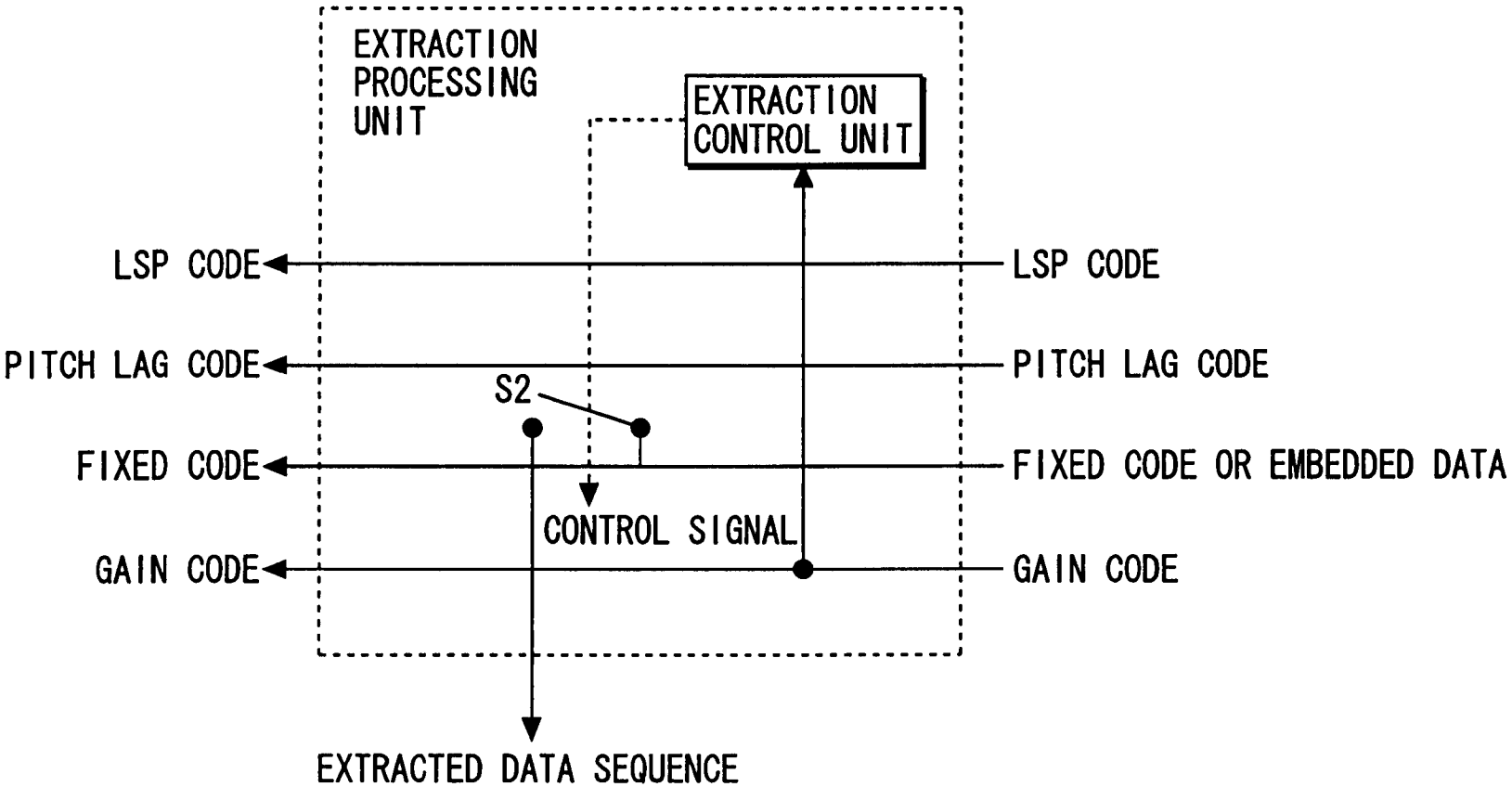
FIG. 10 is a diagram showing an example of a configuration of a data extraction processing unit.

FIG. 10 is a block diagram showing an example of a configuration of the data extraction processing unit. The extraction processing unit has an extraction control unit and a switch S2. An LSP code, a pitch lag code, a fixed code, and a gain code are inputted from the separation unit to the extraction processing unit. Similarly to the embedding control unit, the gain code is inputted as the control parameter (judgment parameter) to the extraction control unit.

The extraction control unit judges whether or not a gain exceeds a predetermined threshold (synchronization with the embedding control unit is obtained) to give the switch S2 a control signal used to turn ON/OFF the switch S2 on the basis of the judgment results. That is to say, the extraction control unit, when the gain exceeds the predetermined threshold, turns OFF the switch S2. On the other hand, the extraction control unit, when the gain does not exceed the predetermined threshold, turns ON the switch S2. As a result, the embedded data as the fixed code is outputted from a branch line. In such a manner, the embedded data is extracted. Thus, the extraction processing unit controls ON/OFF states for the extraction processing for every frame in accordance with the change-over control for the switch S2 made by the extraction control unit. The extraction control unit has the same configuration as that of the above-mentioned embedding control unit. Consequently, the embedding processing and the extraction processing are usually executed synchronously with each other.

As described above, in accordance with the basic technique, arbitrary data can be embedded without changing the encoding format of CELP. In other words, ID information or other media information can be embedded in the voice information to be transmitted/stored without injuring compatibility essential to the application of communication/storage, and without being known to any of users.

In addition, in accordance with the basic technique, the control specification is regulated using the parameters common to the CELP method such as the gain, and the adaptive/fixed codebook. For this reason, the basic technique can be applied to various kinds of methods with out being limited to a specific method. For example, the basic technique can be applied to G.729 for VoIP or AMR for mobile communication.

Now, in the basic technique, the fixed code gain and the adaptive code gain are grasped as the degree of contribution to the voice quality to be used as the judgment parameters. In general, the voice has the characteristics that the fixed code gain is increased on a consonant portion having high noise characteristics, and the adaptive code gain is increased in a vowel portion having high pitch characteristics. Consequently, a change of each gain in the input voice is grasped, whereby data can be embedded in a portion (section) which is free from any of influences exerted on the voice quality.

However, under the background noise environment in which a background noise is superimposed on an input voice, this becomes a problem. In a voice on which the background noise is superimposed, a voice component is masked by a component of the background noise. For this reason, the above-mentioned characteristics of the gain parameter become dull. This phenomenon becomes more conspicuous as an SNR (Signal to Noise Ratio: a ratio of a background noise power to an input voice power) becomes larger. Consequently, the characteristics of the voice cannot be accurately grasped by the basic technique, and hence there is a possibility that the degradation of the voice quality due to misjudgment of an embedded section is caused.

On the other hand, if a control threshold is adjusted so as to avoid such degradation of the voice quality, then a frequency at which a frame is judged as an embeddable frame is largely reduced. For this reason, a data embedding rate under the background noise is greatly reduced.

Figure 11:
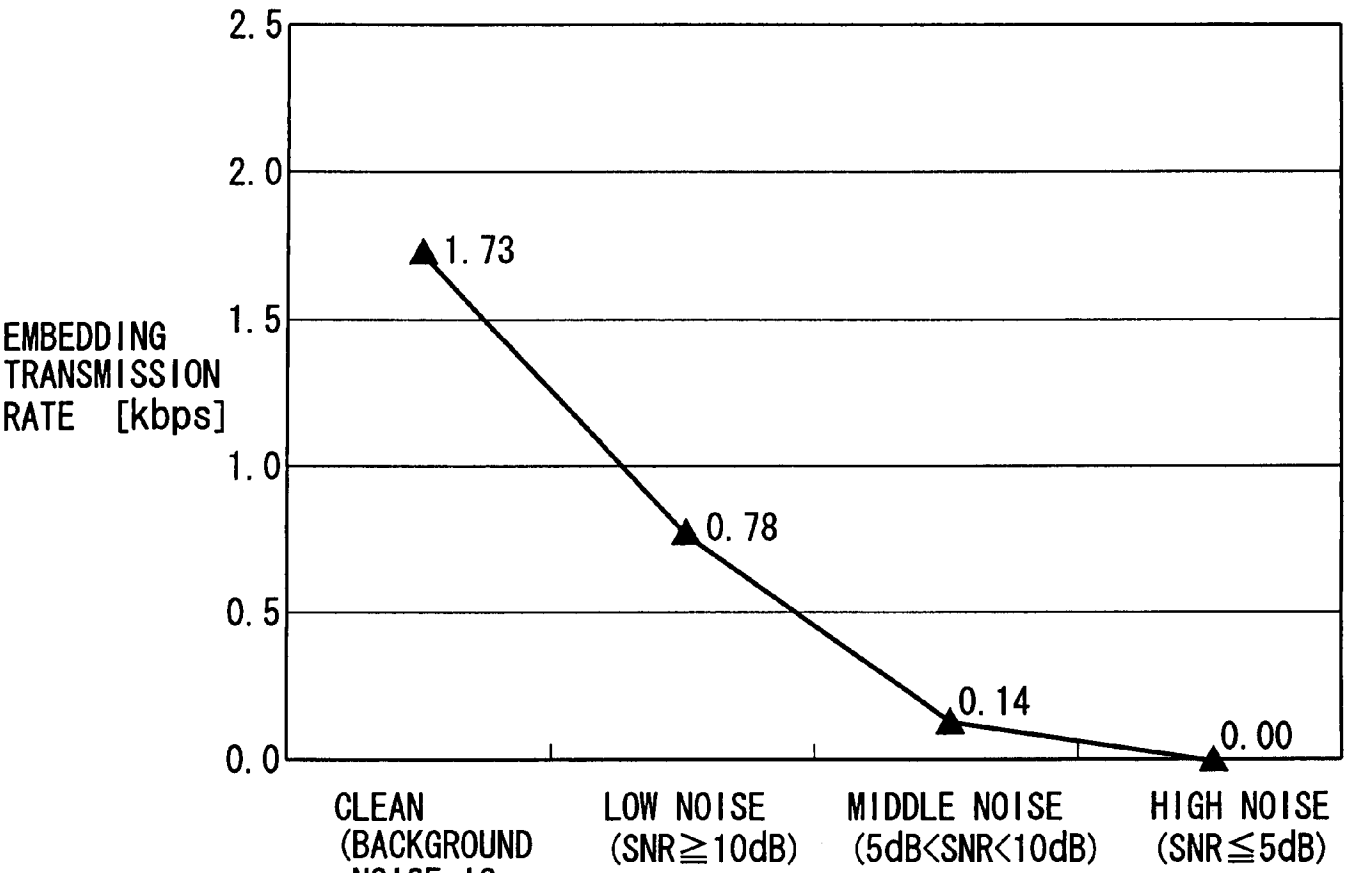
FIG. 11 is a graphical representation useful in explaining an embedded data transmission rate plotted against various levels of a background noise in a basic technique.

FIG. 11 is a graphical representation showing an embedded data transmission rate plotted against various levels of a background noise when the basic technique is applied to the G.729 method. The data transmission rate is greatly reduced as the background noise level becomes larger. In particular, under the high noise condition, the accurate judgment cannot be carried out at all. For this reason, it is understood that the data embedding becomes impossible (in FIG. 11, clean: background noise is absent, low noise: SNR=10 dB, middle noise: 5 dB<SNR<10 dB, high noise: SNR=5 dB. The embedded data transmission rate is calculated under a condition in which 60% of the input voice data corresponds to a non-speech section).

As described above, in the case of the basic technique, the performance for judging the embedding is reduced under the background noise environment, and hence there is a possibility that the degradation of the voice quality due to the misjudgment for an embedding section may be caused. In addition, in a case where this degradation of the voice quality is intended to be avoided, the performance for embedding data is greatly reduced.

The first invention is an attempt to solve the problems associated with the basic technique as described above, and aims at providing stable data embedding performance without exerting a large influence on voice quality even under the background noise environment.

<Summary of First Invention>

Figure 12:
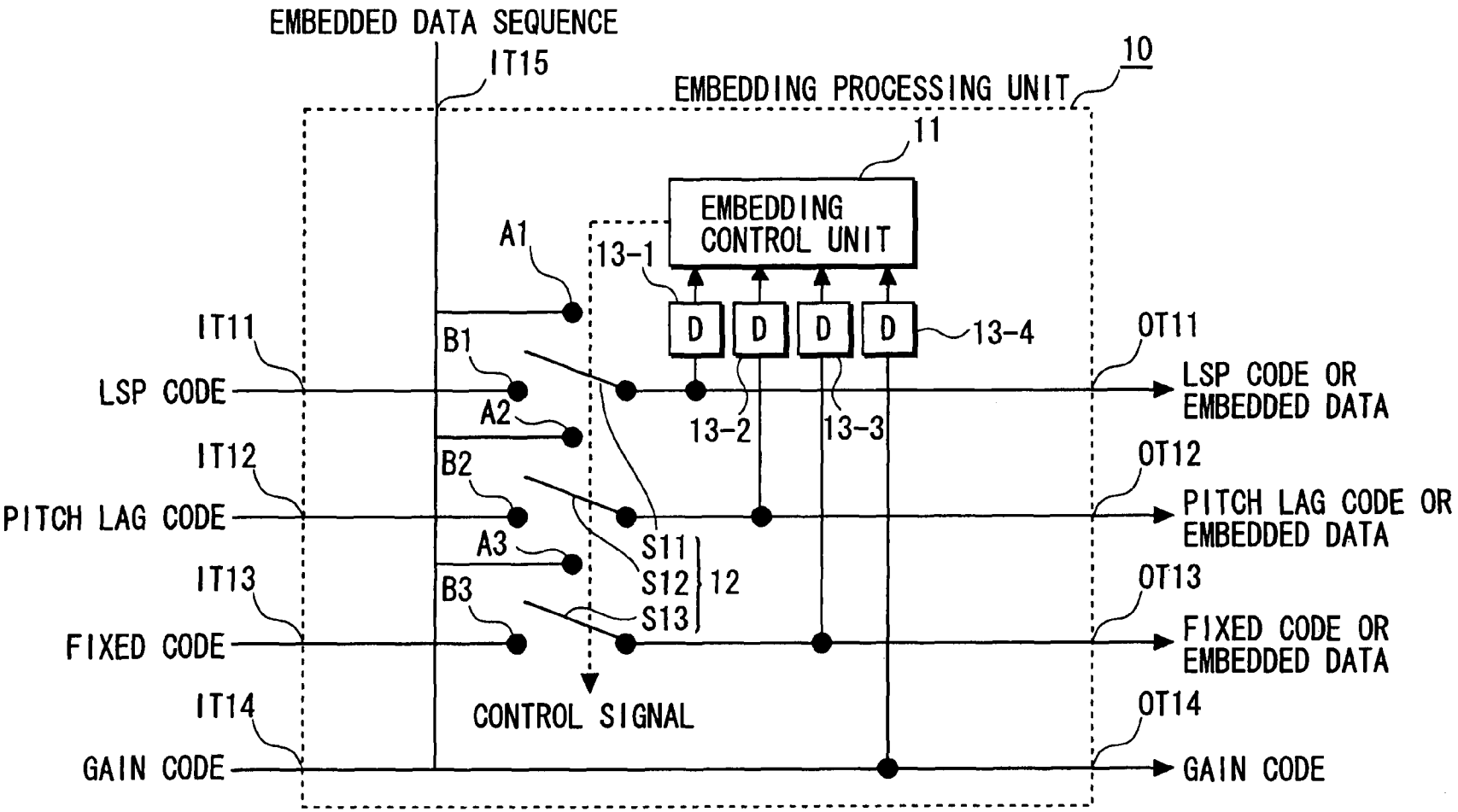
FIG. 12 is a diagram showing an example of a configuration of a data embedding processing unit according to a first invention.
Figure 13:
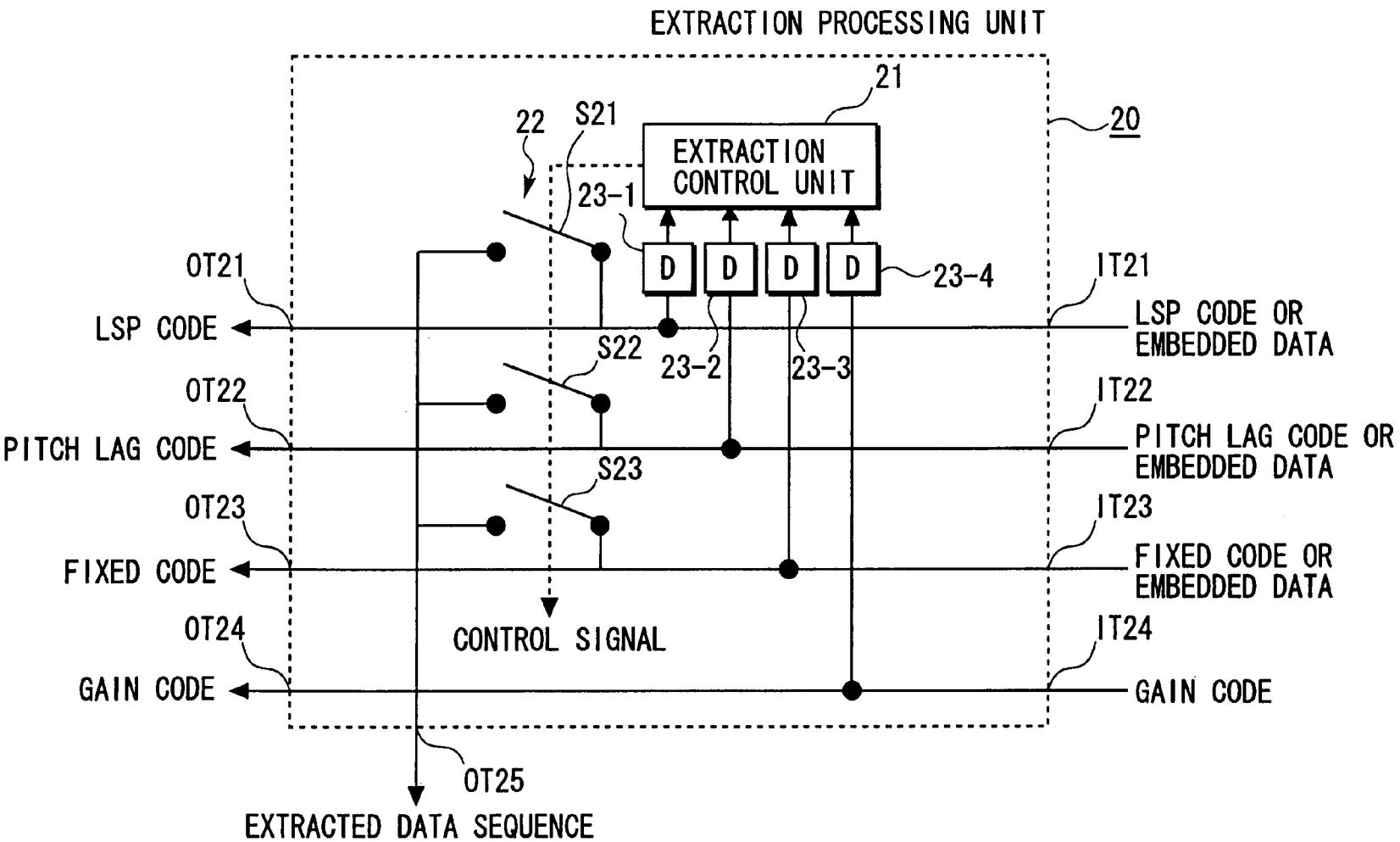
FIG. 13 is a diagram showing an example of a configuration of a data extraction processing unit according to the first invention.

Next, a summary of the first invention will be described. FIG. 12 is a diagram showing an example of a configuration of a data embedding unit according to the first invention, and FIG. 13 is a diagram showing an example of a configuration of a data extraction unit according to the first invention.

The features of the first invention are as follows. (A) A plurality of parameters (encoding parameters) containing the LSP code, the pitch lag code, the fixed code, and the gain code are used as the control parameters (judgment parameters) for data embedding/extraction. (B) Data is embedded in a plurality of parameter codes containing the pitch lag code, the fixed code, and the LSP code. (C) The judgment control for data embedding/extraction is carried out using the past parameter codes after data was embedded.

A flow of a processing in the first invention will herein below be described in order.

(Processing for Embedding Data)

An embedding processing unit 10 (corresponding to data extraction device of the present invention) according to the first invention as shown in FIG. 12 is applied as an embedding processing unit of the encoder as shown in FIG. 6. The embedding processing unit 10 includes an embedding control unit 11 (corresponding to embedding judgment unit of the present invention) for judging whether or not data should be embedded in a predetermined parameter code (embedding object parameter) using predetermined control parameters (judgment parameters), a switch 12 (corresponding to embedding unit of the present invention) for selecting one of the parameter code and the embedded data sequence in accordance with the control made by the embedding control unit 11, and a delay element group 13 for giving the embedding control unit 11 the past judgment parameters.

More specifically, the embedding processing unit 10 has a plurality of input terminals IT11, IT12, IT13, and IT14 for receiving as their inputs the LSP code, the pitch lag code, the fixed (or noise) code, and the gain code outputted from the CELP encoder (FIG. 6), respectively. In addition, the embedding processing unit 10 has an output terminal OT11 for outputting therethrough the LSP code or the embedded data, an output terminal OT12 for outputting therethrough the pitch lag code or the embedded data, an output terminal OT13 for outputting therethrough the fixed code or the embedded data, and an output terminal OT14 for outputting therethrough the gain code. The parameter codes or embedded data outputted through the output terminals OT1 to OT4, respectively, are inputted to the multiplexing unit (FIG. 6). Moreover, the embedding processing unit 10 has an input terminal IT15 for receiving as its input the embedded data sequence.

The switch 12 includes switches S11, S12, and S13, each which are interposed between the input terminals IT11, IT12, and IT13, and the output terminals OT11, OT12, and OT13. The switches S11, S12, and S13 select ones of end points A1, A2, and A3 on an embedded data side, and end points B1, B2, and B3 on an input terminal side (parameter code side) to transmit through the parameter codes or embedded data inputted through the input terminals on the selected side to the output terminal side. The selection (change-over) operation of the switch 12 (the switches S11, S12, and S13) is controlled by the embedding control unit 11.

The delay element group 13 is constituted by delay elements 13-1 to 13-4 for receiving as their inputs the LPS code (or the embedded data), the pitch lag code (or the embedded data), the fixed code (or the embedded data), and the gain code, respectively. After the delay elements 13-1 to 13-4 delay the inputted parameter codes (or embedded data) by a fixed period of time (for a predetermined number of frames), the delay elements 13-1 to 13-4 input the parameter codes (or embedded data) thus delayed to the embedding control unit 11.

The embedding control unit 11 receives a plurality of parameter codes (the LSP code, the pitch lag code, the fixed code, and the gain code) inputted through the delay element group 13 as the judgment parameters. Then, the embedding control unit 11 judges whether or not the embedding processing should be executed on the basis of the judgment parameters. When the embedding control unit 11 judges that the embedding processing should be executed, the embedding control unit 11 gives the switch 12 a control signal in accordance with which the switches S11 to S13 select the end points A1 to A3, respectively. On the other hand, when the embedding control unit 11 judges that the embedding processing should not be executed, the embedding control unit 11 gives the switch 12 a control signal in accordance with which the switches S11 to S13 select the end points B1 to B3, respectively.

With the above-mentioned configuration, the embedding processing unit 10 includes the following function. The LSP code, the pitch lag code, the fixed code, and the gain code outputted from the CELP encoder are all inputted to the embedding processing unit 10.

The switch 12 (the switches S11 to S13) carries out the operation for change-over between the end points in accordance with the control signal outputted from the embedding control unit 11. As a result, the change-over of the LSP code, the pitch lag code, and the fixed code to the embedded data sequence, i.e., the embedding of the data is carried out. At this time, the embedded data sequence is divided in accordance with the number of bits of the parameter codes (quantity of information) to be replaced with the corresponding parameter codes. In such a manner, the LSP code, the pitch lag code, and the fixed code are used as the embedding object parameters.

When no embedding of data is carried out, no replacement of data is carried out. That is to say, the parameter codes inputted through the input terminals IT1 to IT4, respectively, are outputted through the output terminals OT1 to OT4 in their entireties.

The parameter codes after completion of the embedding processing are inputted to the embedding control unit 11. At this time, the past parameter codes which have been delayed by a fixed period of time (for a fixed number of frames) by the delay element group 13 are inputted to the embedding control unit 11. The embedding control unit 11 carries out the embedding judgment using the parameters containing the LSP, the pitch lag, the fixed code word, and the gain as the judgment parameters to output the judgment results in the form of a control signal to the switch 12.

Note that, the switches S11 to S13 may also be configured so as for the above-mentioned switching operations to be individually controlled in accordance with increase and decrease in the embedding object parameters. In this case, the switching operations of switches of the extraction processing unit that will be described later are carried out synchronously with the switching operations of the switches S11 to S13.

(Data Extraction Processing)

An extraction processing unit 20 (corresponding to data extraction device of the present invention) according to the first invention as shown in FIG. 13 is applied as an extraction processing unit of the decoder as shown in FIG. 6. The extraction processing unit 20 includes an extraction control unit 21 (corresponding to extraction judgment unit of the present invention) for judging whether or not data should be extracted from predetermined parameter codes (extraction object parameters) using predetermined control parameters (judgment parameters), a switch 22 (corresponding to extraction unit of the present invention) for selecting between cutting out and stop of cutting out of embedded data in accordance with the control made by the extraction processing unit 21, and a delay element group 23 for giving the extraction control unit 21 the past judgment parameters.

More specifically, the extraction processing unit 20 has a plurality of input terminals IT21, IT22, IT23, and IT24 for receiving as their inputs the LSP code (or the embedded data), the pitch lag code (or the embedded data), the fixed (or noise) code (or the embedded data), and the gain code outputted from the separation unit (FIG. 6), respectively. In addition, the extraction processing unit 20 has output terminals OT21, OT22, OT23, and OT24 for outputting therethrough a plurality of parameter codes inputted through the input terminals IT21, IT22, IT23, and IT24, respectively. A plurality of parameter codes outputted through these output terminals OT21 to OT24, respectively, are all inputted to the CELP decoder (FIG. 6). Moreover, the extraction processing unit 20 has an output terminal OT25 for outputting therethrough the embedded data cut out by the switch 22.

The switch 22 includes switches S21, S22, and S23 for output/stop of output of the parameter codes inputted through the input terminals IT21, IT22, and IT23, respectively, to the output terminal OT25. When the switches S21, S22, and S23 become a turn-ON state, the parameter codes that are transmitted from the input terminals IT21, IT22, and IT23 towards the output terminals OT21, OT22, and OT23, respectively, are branched in order to be transmitted towards the output terminal OT25. On the other hand, when the switches S21, S22, and S23 become a turn-OFF state, the parameter codes inputted through the input terminals IT21 to IT23, respectively, are outputted only through the corresponding output terminals OT21 to OT23. The switching operation of the switch 22 (the switches S21, S22, and S23) is controlled by the extraction control unit 21.

The delay element group 23 is constituted by delay elements 23-1 to 23-4 for receiving as their inputs the LSP code (or the embedded data), the pitch lag code (or the embedded data), the fixed code (or the embedded data), and the gain code, respectively. After the delay elements 23-1 to 23-4 delay the inputted parameter codes (or the embedded data) by a fixed period of time (for a predetermined number of frames), the delay elements 23-1 to 23-4 input the parameter codes (or the embedded data) thus delayed to the extraction control unit 21.

The extraction control unit 21 receives a plurality of parameter codes (the LSP code, the pitch lag code, the fixed code, and the gain code) inputted through the delay element group 23 as the judgment parameters. The extraction control unit 21 judges whether or not the extraction processing should be executed on the basis of the judgment parameters. The extraction control unit 21, judging that the extraction processing should be executed, gives the switch 22 a control signal to turn ON the switches S21 to S23. On the other hand, the extraction control unit 21, judging that the extraction processing should not be executed, gives the switch 22 a control signal to turn OFF the switches S21 to S23.

The extraction processing unit 20 configured as described above has the following function. The parameter codes inputted from a transmission (embedding) side to the extraction processing unit 20 are inputted to the extraction control unit 21. At this time, similarly to the embedding side, the past parameter codes are inputted to the extraction control unit 21 for a fixed period of time (for a fixed number of frames) by the delay element group 23.

The extraction control unit 21 has the same configuration as that of the embedding control unit 11, and judges whether or not the data should be extracted using a plurality of parameters containing the LSP, the pitch lag, the fixed code word, and the gain to output the judgment results in the form of a control signal to the switch 22.

Then, the switch 22 carries out the change-over (switching) operation in accordance with the control signal outputted from the extraction control unit 21 to control the extraction (cutting out) of the data from the respective embedding object parameters. At this time, the data sequences are respectively cut out from the embedding object parameter codes in accordance with the number of bits (quantity of information) corresponding to the embedding object parameter codes, and the data sequences thus cut out are synthesized with one another to be outputted in the form of an extracted data sequence through the output terminal OT25.

As described above, the encoder (transmission side) including the embedding processing unit 11, and the decoder (reception side) including the extraction processing unit 21 are operated synchronously with each other. That is to say, the embedding processing and the extraction processing for the above-mentioned embedded data sequence are executed synchronously with each other.

<<Operation of First Invention>>

Next, an operation of the first invention will be described as for every feature.

(Operation Due to Feature (A))

In the first invention, as for a feature (A), the parameters such as the LSP exhibiting a spectrum of frequency of a voice signal, the pitch lag exhibiting a pitch period, and the signal power at a level of a regenerative signal, in addition to the gain exhibiting a degree of contribution of a sound source signal, are used as a judgment threshold for embedding/extraction. As a result, the embedding judgment which is more accurate than that in the basic technique becomes possible under the background noise environment. In particular, the LSP is a parameter representing formant characteristics specific to a voice, and hence is hardly influenced by the background noise. Thus, the LSP is the most suitable for the embedding judgment parameter.

(Operation Due to Feature (B))

In the first invention, as for a feature (B), data is embedded in a plurality of parameter codes containing therein at least one parameter used as the judgment parameter. As a result, a quantity of embedded data per frame is increased. Consequently, it is possible to suppress reduction of an embedding transmission rate due to reduction of an embedding frequency under the background noise environment.

(Operation Due to Feature (C))

In the first invention, as for a feature (C), the past parameter codes after execution of the embedding processing are used as the judgment parameters for embedding/extraction. As a result, it is possible to guarantee the synchronization between the embedding side and the extraction side. In addition, data embedded on the transmission side can be properly extracted on the reception side without adding any of control parameters for extraction.

Embodiments of First Invention

Next, embodiments of the first invention of the present invention will be described with reference to the drawings. Configurations of the embodiments are merely exemplifications, and hence the present invention is not intended to be limited to the configurations of the embodiments.

First Embodiment

Figure 14:
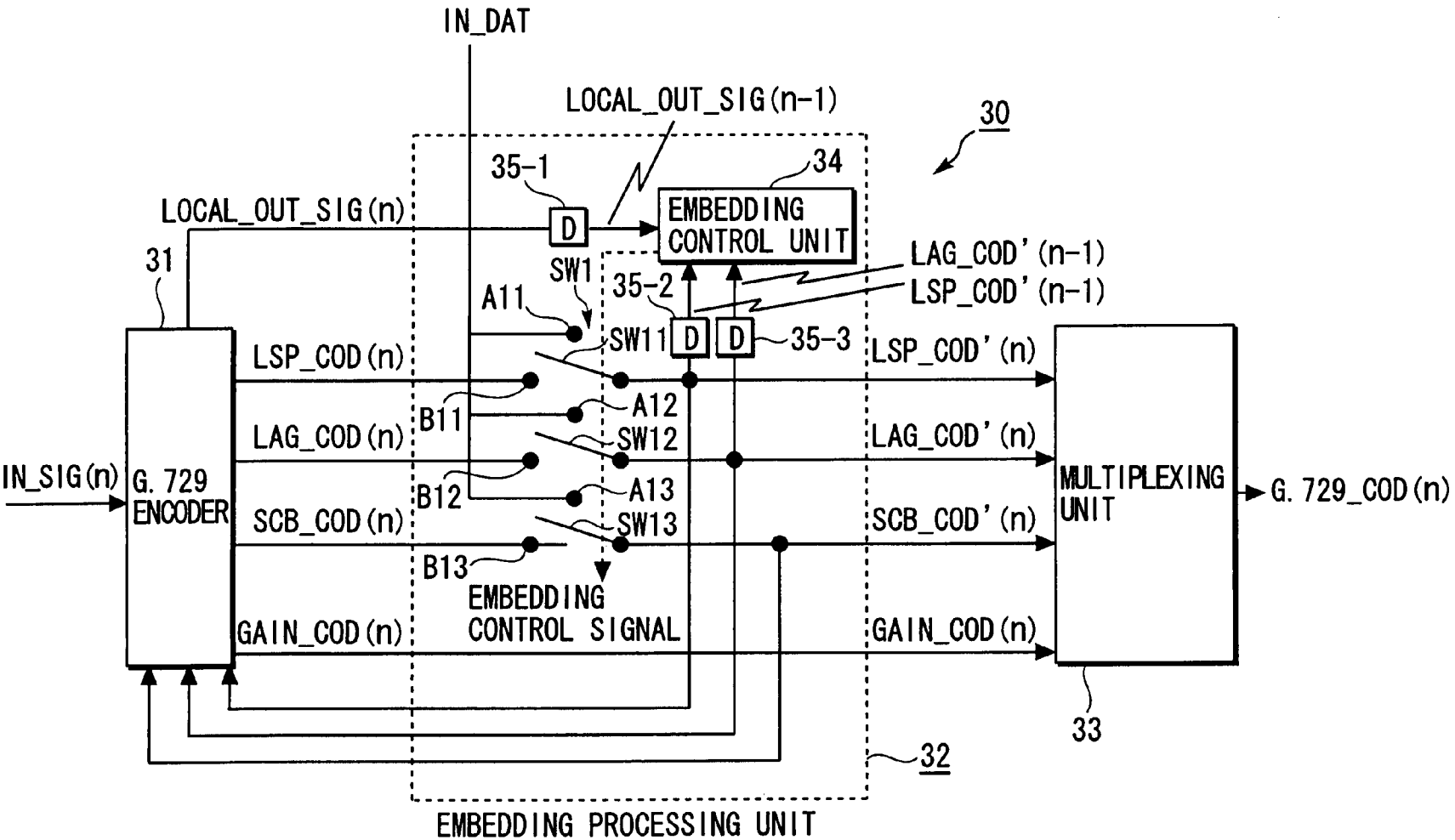
FIG. 14 is a diagram showing a structure in a first embodiment of the first invention (embedding of data in a G.729 speech code)

FIG. 14 is a diagram showing an example of a configuration of a first embodiment of the first invention. A description will now be given with respect to an encoder 30 (data embedding side) when an embedding method according to the first invention is applied to a speech encoding method (G.729 method) of ITU-T G.729 as the first embodiment.

In FIG. 14, the encoder 30 (corresponding to data transmission device of the present invention) includes a G.729 encoder 31, an embedding processing unit 32 (corresponding to data embedding device of the present invention) provided in an after stage of the encoder 31, and a multiplexing unit 33 provided in an after stage of the embedding processing unit 32.

(Outline of G.729 Method)

FIG. 15A is a table (Table 1) showing items of G.729 method, and FIG. 15B is a table (Table 2) showing transmission parameters and quantization bit assignment. In the G.729 method, an input signal having a frame length of 10 ms (80 samples) is encoded so as to have 80 bits. The G.729 method is basically a CELP method-based method. As for its feature, an algebraic codebook including four pulses is used as a fixed codebook. Consequently, transmission parameters are an LSP, a pitch lag, an algebraic code (algebraic codebook index), and a gain.

(Embedding Object Parameters)

Figure 16:
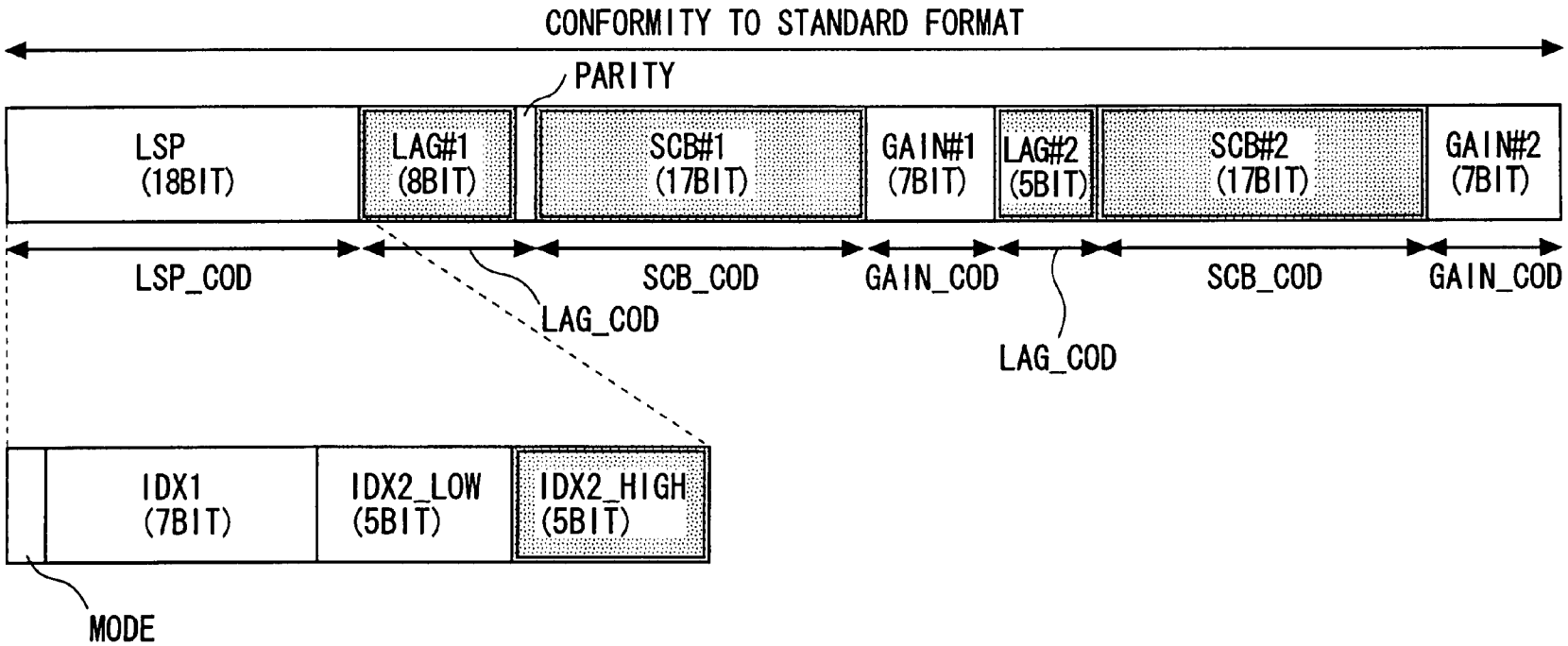
FIG. 16 is diagram of a structure of a speech code in a G.729 method according to the first invention.

FIG. 16 is diagram useful in explaining a structure of a speech code conforming to the G.729 method, and embedding object parameters in the embodiments. In the first embodiment, embedding of data is carried out with an algebraic code SCB_COD (34 bits (17 bits+17 bits)), a pitch lag code LAG_COD (13 bits (8 bits+5 bits)), and a part (5 bits) of an LSP code LSP_COD constituted by 18 bits as an embedding object.

Now, 5 bits as a part of the LSP code will be described. An LSP quantizer (included in the encoder 31) conforming to the G.729 method has such a configuration as to vector-quantize an error between 10 LSP predictors predicted using MA prediction and an actual LSP using two-stage structured quantization table. Consequently, 18 bits of the LSP code, as shown in FIG. 16, is constituted by change-over information NODE (1 bit) of an MA prediction coefficient, an index Idx1 (7 bits) of a quantization table of the first stage, an index Idx2_low (5 bits) of a low-order side quantization table of the second stage, and an index Idx2_high (5 bits) of a high-order side quantization table of the second stage. As a result of a preliminary examination, it was made clear that the index idx2#high of the high-order side quantization table of the second stage of the LSP, in addition to the algebraic code and the pitch lag code, has only a small influence on voice quality in a non-speech section. For this reason, 5 bits concerned is made an embedding object.

Consequently, in this embodiment, data is embedded in 52 bits out of 80 bits constituting one frame of the speech code conforming to the G.729 method.

(Data Embedding Processing)

In the first embodiment, the frame in the non-speech section having a small influence on conversational voice quality is regulated as an embedding object frame, and data is embedded in this embedding object frame. A VAD (Voice Active Detector) technique can be applied to detection of the non-speech section. The VAD is a technique for analyzing a plurality of parameters obtained from an input signal to judge whether the section (signal) concerned is a speech section or a non-speech section (this technique is well known from the patent literatures 3 and 4 for example).

The embedding control unit 34 (corresponding to embedding judgment unit of the present invention) shown in FIG. 14 includes the VAD. When it is judged using the VAD that the section concerned is the non-speech section, the embedding control unit 34 sets the switches SW11, SW12, and SW13 of the switch SW1 (corresponding to embedding unit of the present invention) to the end points A11, A12, and A13, respectively, on a side of the embedding data sequence IN_DAT to execute the embedding processing. On the other hand, when it is judged using the VAD that the section concerned is the speech section, the embedding control unit 34 sets the switches SW11, SW12, and SW13 of the switch SW1 to the end points B11, B12, and B13 so that no data embedding processing is executed.

The VAD applied to the first embodiment requires the LSP, the pitch lag, and the regenerative signal (generated from all the transmission parameters) as the input parameters for section judgment (for embedding judgment). In other words, all the transmission parameters containing the LSP, the pitch lag, the algebraic code (fixed code), and the gain become necessary for the control for the embedding and extraction processing.

Consequently, it is necessary to take it into consideration that the embedding object parameters (the LSP, the pitch lag, and the algebraic code) are contained in the parameters for embedding judgment control. The data embedding processing will hereinbelow be described in order with reference to FIG. 14.

First of all, an input voice signal IN_SIG(n) is inputted to a G.729 encoder 31 for every frame (80 samples). Here, the input voice signal IN_SIG(n) is a linear PCM signal of 16 bits obtained through the sampling at 8 kHz. In addition, "n" in FIG. 14 is a frame number of a current frame. The G.729 encoder 31 encodes the input voice signal IN_SIG(n) to output an LSP code LSP_COD(n), a pitch lag code LAG_COD (n), an algebraic code SCB_COD (n), and a gain code GAIN_COD (n) as the encoding parameters (parameter codes). In addition, the G.729 encoder 31 outputs an LPC synthetic filter output LOCAL_OUT(n) generated through the process of the encoding processing to the embedding control unit 34. Here, the encoding processing executed by the G.729 encoder 31 is the same as that based on the G.729 standard.

The embedding control unit 34 judges whether or not data should be embedded in a speech code of a current frame n. As described above, the embedding control unit 34 includes the VAD. The embedding control unit 34 analyzes the parameters of the inputted LSP, the pitch lag, and the regenerative signal to detect (a frame of) the non-speech section to output an embedding control signal to the switch SW1. Note that, the embedding control unit 34 previously has a threshold with which it is judged on the basis of the input parameters whether a frame corresponds to a speech section or a non-speech section.

When it is judged as a result of the detection that the frame corresponds to (a frame of) the non-speech section, the embedding control unit 34 sets the switch SW1 to the side of the end points A11 to A13 to replace a part of LSP_COD (n), LAG_COD (n), and SCB_COD (n) as the embedding object codes with the embedded data sequence IN_DAT to output the resultant codes in the form of LSP_COD(n)', LAG_COD (n)', and SCB_COD(n)' to the multiplexing unit 33.

Here, in order to guarantee the synchronization between the embedding processing and the extraction processing, it is necessary to use the encoded parameters (parameter codes) obtained after being subjected to the embedding processing as the encoded parameters used in the embedding control. Then, in the first embodiment, as shown in FIG. 14, the delay elements 35-1, 35-2, and 35-3 for providing a delay for one frame are provided, and an LSP code LSP_COD' (n−1), a pitch lag code LAG_COD' (n−1), and a regenerative signal LOCAL_OUT_SIG (n−1) which are all the past codes by one frame are inputted to the embedding control unit 34 (VAD).

The multiplexing unit 33 multiplexes the inputted encoded parameters (LSP_COD' (n), LAG_COD' (n), SCB_COD' (n), and GAIN_COD (n)) so as to meet the structure shown in FIG. 16 to output the resultant code in the form of a G.729 speech code G.729_COD(n) of an n-th frame to the decoder side.

(Update of Memory States by G.729 Encoder)

Moreover, in order to guarantee the synchronization between the encoder and the decoder, the encoder 30 updates memory states using the transmission parameters obtained after being subjected to the embedding processing. More specifically, as shown in FIG. 14, the transmission parameters (LSP_COD' (n), LAG_COD' (n), and SCB_COD' (n)) obtained after being subjected to the embedding processing are inputted to the G.729 encoder 31 to generate a sound source signal to thereby update memory states of the adaptive codebook and the LPC synthesis filter (e.g., refer to FIG. 3). The processing for updating memory states is the same as that essential to the G.729 standard. In addition, the regenerative signal LOCAL_OUT_SIG(n) generated through this process is, as described above, outputted in the form of a parameter for embedding control for a next frame towards the embedding control unit 33.

Second Embodiment

Figure 17:
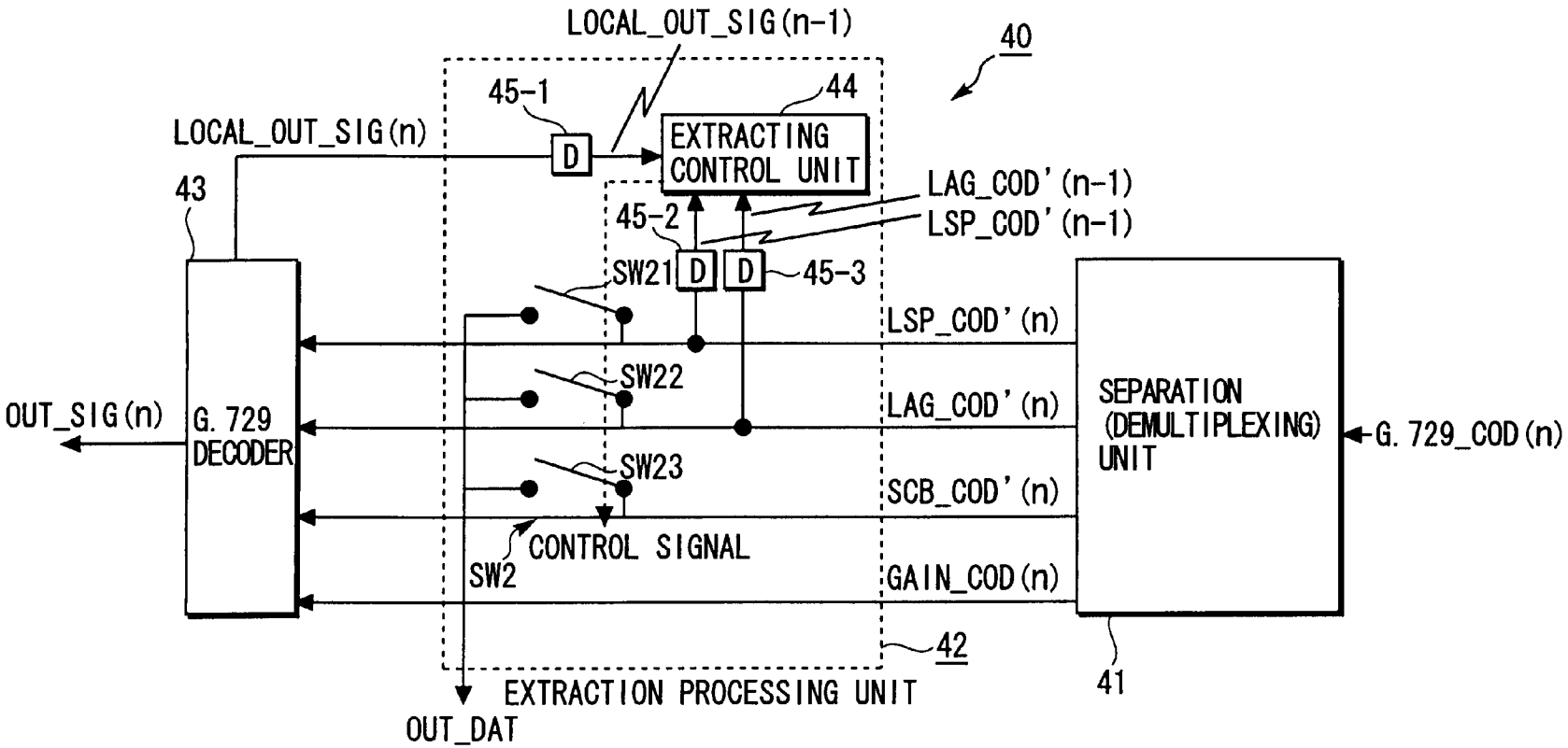
FIG. 17 is a diagram showing a configuration in a second embodiment of the first invention (extraction of data from the G.729 speech code)

FIG. 17 is a diagram showing an example of a configuration of a second embodiment of the first invention. The second embodiment is an example of the decoder (on the data extraction side) when the embedding method of the first invention is applied to the ITU-T G.729 speech encoding method. In the second embodiment, the data embedded in the G.729 speech code in the first embodiment is extracted. A data extraction processing will herein below be described in order with reference to FIG. 17.

In FIG. 17, a decoder 40 (corresponding to data reception device of the present invention) includes a separation unit 41, an extraction processing unit 42 (corresponding to data extraction device of the present invention) provided in an after stage of the separation unit 41, and a G.729 decoder 43 provided in an after stage of the extraction processing unit 42.

A speech code G.729_COD(n) conforming to the G.729 method which has been transmitted from an encoder side (e.g., from the encoder 30) is inputted to the separation unit 41. Then, the separation unit 41 separates the speech code G.729_COD(n) into a plurality of parameter codes (LSP_COD' (n), LAG_COD' (n), SCB_COD' (n), and GAIN_COD (n)) to input the resultant parameter codes to the extraction processing unit 42.

The extraction processing unit 42 includes an extraction control unit 44 (corresponding to extraction judgment unit of the present invention), a switch SW2 (switches SW21, SW22, and SW23: corresponding to extraction unit of the present invention), and delay elements 45-1, 45-2, and 45-3. The extraction control unit 44 judges whether or not the data should be extracted from a speech code of a current frame n.

Here, the extraction control unit 44 has completely the same configuration as that of the embedding control unit 34 in the first embodiment. Then, parameters containing an LSP code LSP_COD' (n−1), a pitch lag code LAG_COD' (n−1), and a regenerative signal LOCAL_OUT_SIG (n−1) before one frame which have passed through the delay elements 45-1, 45-2, and 45-3, respectively, are inputted to the extraction control unit 44. The extraction control unit 44 detects a non-speech section using the VAD on the basis of the inputted parameters to output an extraction control signal to the switch SW2. That is to say, the extraction control unit 44, when the detection results correspond to the non-speech section, turns ON the switch SW2 (the switches SW21, SW22, and SW23) to output a part of LSP_COD' (n), LAG_COD' (n), and SCB_COD' (n) as the embedding object codes in the form of an extracted data sequence OUT_DAT.

The G.729 decoder 43 receives the parameter codes that have been outputted from the separation unit 41 to pass through the extraction processing unit 42. Then, the G.729 decoder 43 decodes the parameter codes to output a regenerative signal OUT_SIG(n) of an n-th frame. Here, the decoding processing executed by the G.729 decoder 43 is the same as that essential to the G.729 standard. In addition, the G.729 decoder 43 outputs an output signal LOCAL_OUT(n) of the LPC synthesis filter which has been generated through the process of the decoding processing towards the extraction control unit 44.

<<Operation and Effects of Embodiments>>

Figure 18:
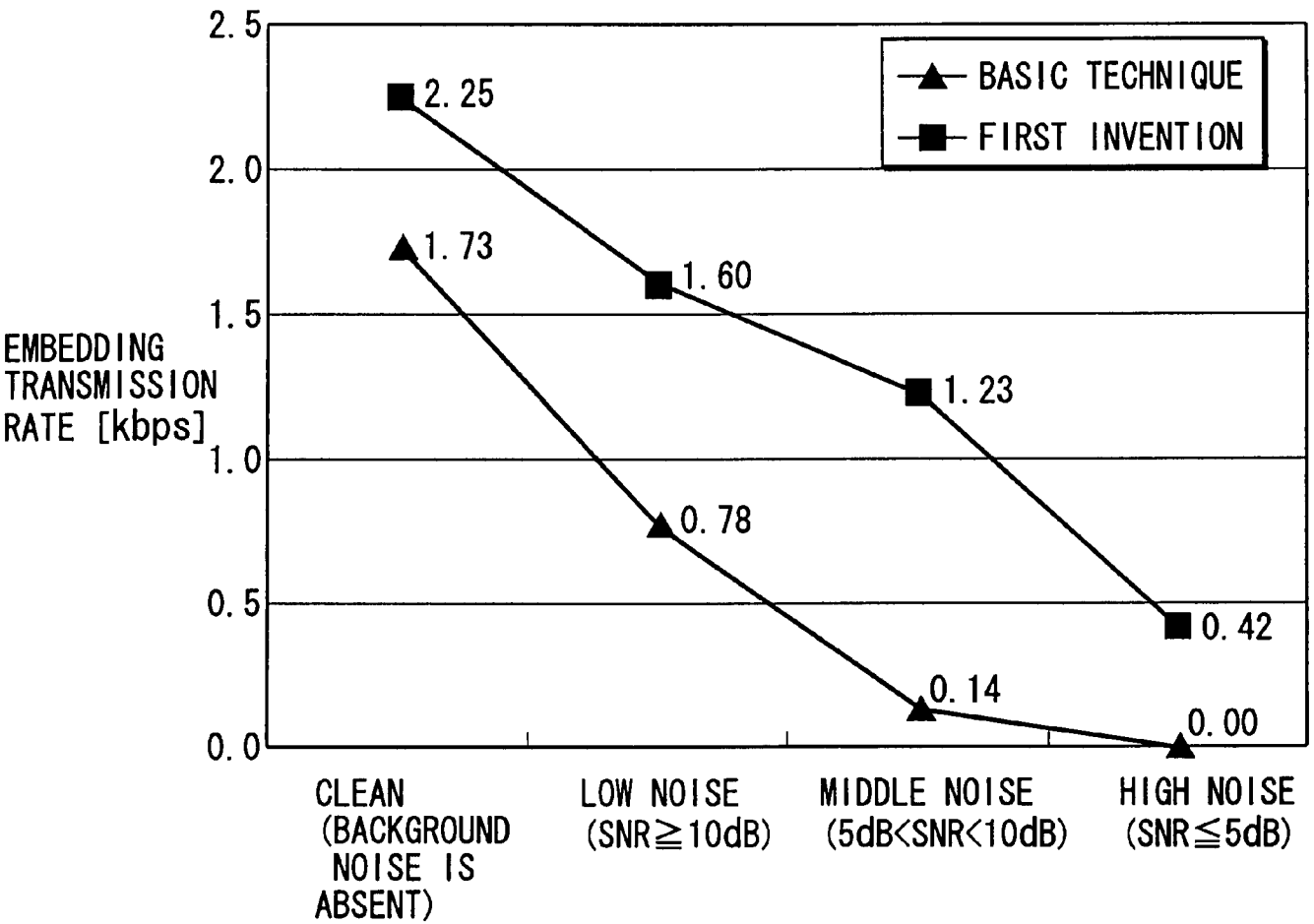
FIG. 18 is a graphical representation useful in explaining comparison in performance between a basic technique and the first invention.

FIG. 18 is a graphical representation showing results of comparison in data embedding performance between the method according to the basic technique and the method according to the first invention. In FIG. 18, the G.729 method is applied as the speech encoding/decoding method.

According to the first invention, data is simultaneously embedded in a plurality of parameters, whereby a quantity of embedded data per frame is increased. As a result, a transmission rate under clean voice conditions is enhanced.

Moreover, according to the first invention, a plurality of parameters are used as embedding judgment parameters. As a result, accuracy of embedding control under background noise conditions is enhanced. Consequently, the embedding transmission rate under the background noise conditions that becomes a problem in the basic technique is greatly increased. In particular, the embedding of data becomes possible even under high noise conditions under which the embedding of data is impossible in the basic technique.

Furthermore, according to the first invention, a non-speech section having a small influence on a voice is judged to embed data in a speech code in a frame of this non-speech section. As a result, the degradation of voice quality due to the embedding of data is hardly caused.

As described above, according to the first invention, the basic performance of the data embedding can be enhanced, and also the performance of the data embedding under the background noise conditions can be greatly improved.

The data embedding method can be applied to a communication system as well such as a mobile phone. In a real environment in which the data embedding method is used, it is important to take into consideration an influence of a background noise on a voice. The present invention enhances the performance in the real environment, and offers a great effect in application of the data embedding method to products.

Note that, the present invention may be constituted in the form of a speech encoder/decoder (speech CODEC (data encoder/decoder): corresponding to data embedding/extraction device and communication device of the present invention) including both the encoder (embedding processing unit) and the decoder (extraction processing unit) as described above.

[Second Invention]

Next, a data embedding technique according to a second invention of the present invention will be described. The second invention relates to a data embedding technique which is realized by replacing a part of a digital data sequence such as multi-media contents (a still picture, a moving picture, an audio signal, a voice and the like) with different arbitrary data.

With such a data embedding technique, different arbitrary information can be embedded in a transmission bit sequence without exerting any of influences on the transmission bit sequence. For this reason, the data embedding technique has become very important in recent years as "a digital watermarking technique" for embedding copyright information in a digital image to prevent unlawful copy, or for embedding ID information in a speech code compressed through speech encoding process to enhance concealment of a call, for example.

<Circumstances of Second Invention>

Next, circumstances of the second invention will be described.

<<CELP>>

In mobile phones which have greatly come into wide use in recent years, or Internet phones which are in the process of gradually becoming popular recently, for the purpose of effectively utilizing a line, a voice is compressed through the encoding process to be transmitted or received in the form of a speech code. In such a speech encoding technique, a CELP (Code Excited Linear Prediction) method is known as an encoding method which can provide excellent voice quality even at a low bit rate. A CELP based encoding method is adopted in many speech encoding standards such as the G.729 method of ITU-T (International Telecommunication Union-Telecommunication Sector) and an AMR (Adaptive Multi Rate) method of 3GPP (3 rd Generation Partnership Project).

Figure 19:
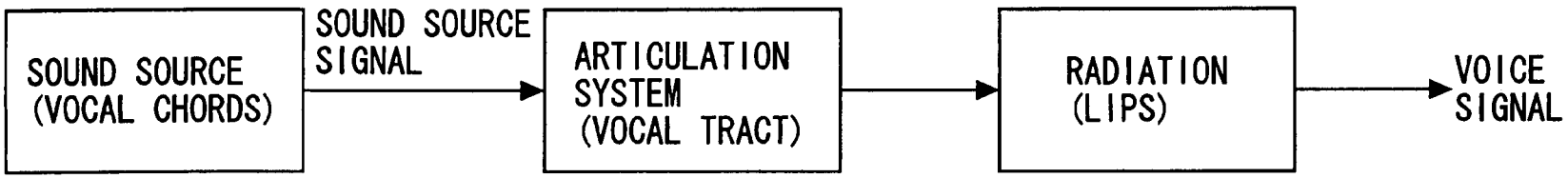
FIG. 19 is a diagram useful in explaining a voice generation model.

The CELP method will hereinbelow be described in brief. The CELP method is a speech encoding method which was published in 1985 by M. R. Schroder and B. S. Atal. With the CELP method, parameters are extracted from an input voice on the basis of a voice generation model of a human being, and the parameters thus extracted are encoded to be transmitted. As a result, information compression at high efficiency is realized. FIG. 19 is a diagram showing a voice generation model. A sound source signal generated in a sound source (vocal chords) is inputted to an articulation system (vocal tract), and the vocal tract characteristics are added to the sound source signal in the vocal tract. Thereafter, a voice is finally outputted in the form of a voice waveform through lips.

Figure 20:
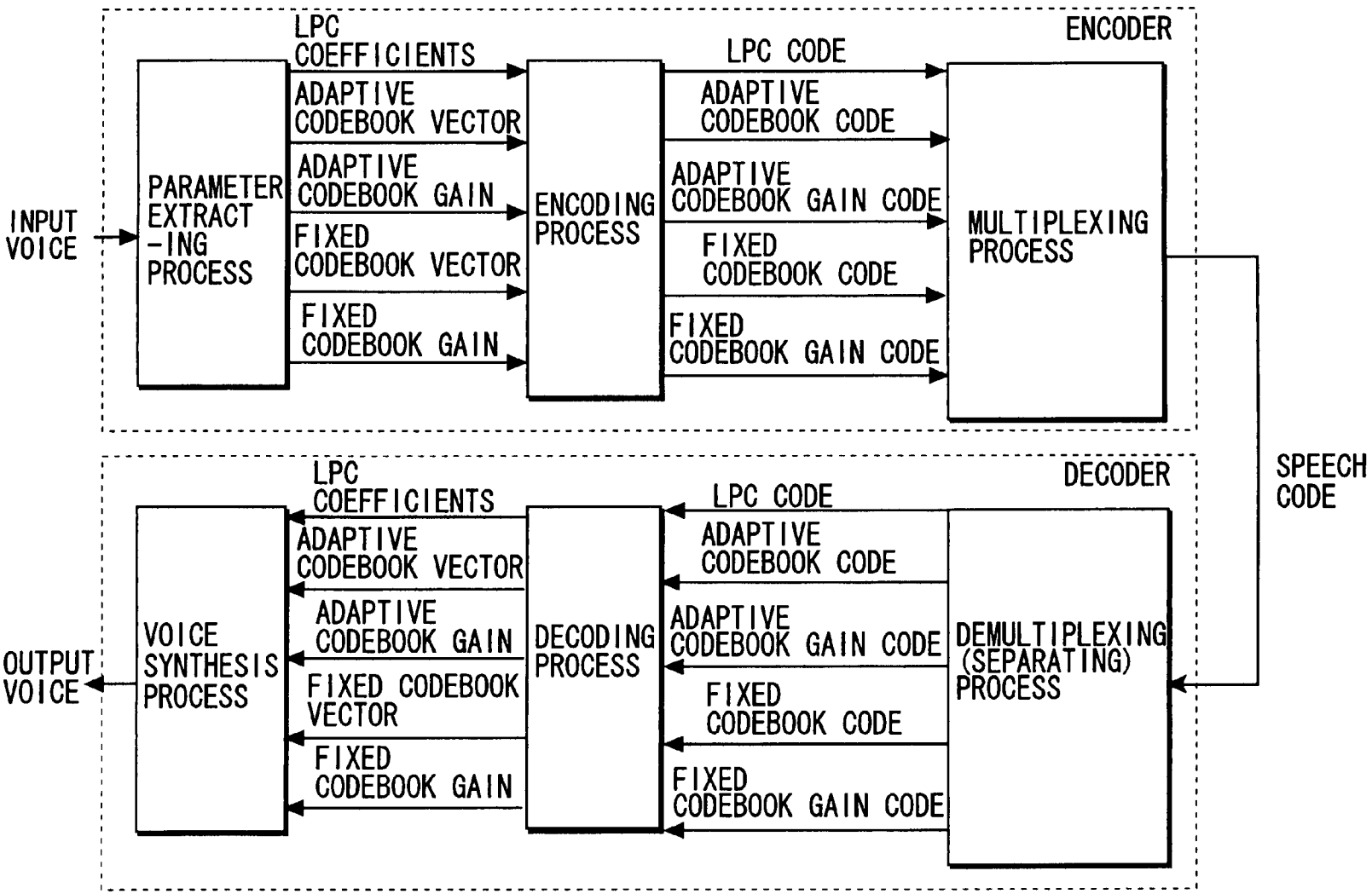
FIG. 20 is a diagram showing a flow of a CELP encoding/decoding processing.

FIG. 20 is a diagram showing a flow of processes in an encoder and a decoder based on the CELP method. The CELP encoder analyzes an input voice on the basis of the above-mentioned voice generation model to separate the input voice into LPC coefficients (Linear Predictor Coefficients) representing the vocal tract characteristics, and a sound source signal. Moreover, the encoder extracts an ACB (Adaptive Codebook) vector which represent a periodic component and an SCB (Stochastic (Fixed) Codebook) vector which represent a non-periodic component of the sound source signal, respectively, and gains of both the vectors from the sound source signal. The processing described above is the parameter extraction processing. In an encoding processing, the LPC coefficients, the ACB vector, the SCB vector, the ACB gain, and the SCB gain are respectively encoded. In a multiplexing processing, a plurality of codes obtained through the encoding in the encoding processing are multiplexed to generate a speech code. The speech code is then transmitted to the decoder.

On the other hand, in a separation processing, the decoder separates the speech code transmitted from the encoder into codes of the LPC coefficients, the ACB vector, the SCB vector, the ACB gain, and the SCB gain. In addition, in a decoding processing, the decoder decodes the codes. Then, in a voice synthesis processing, the decoder synthesizes the parameters decoded through the decoding processing to generate a voice.

Figure 21A:
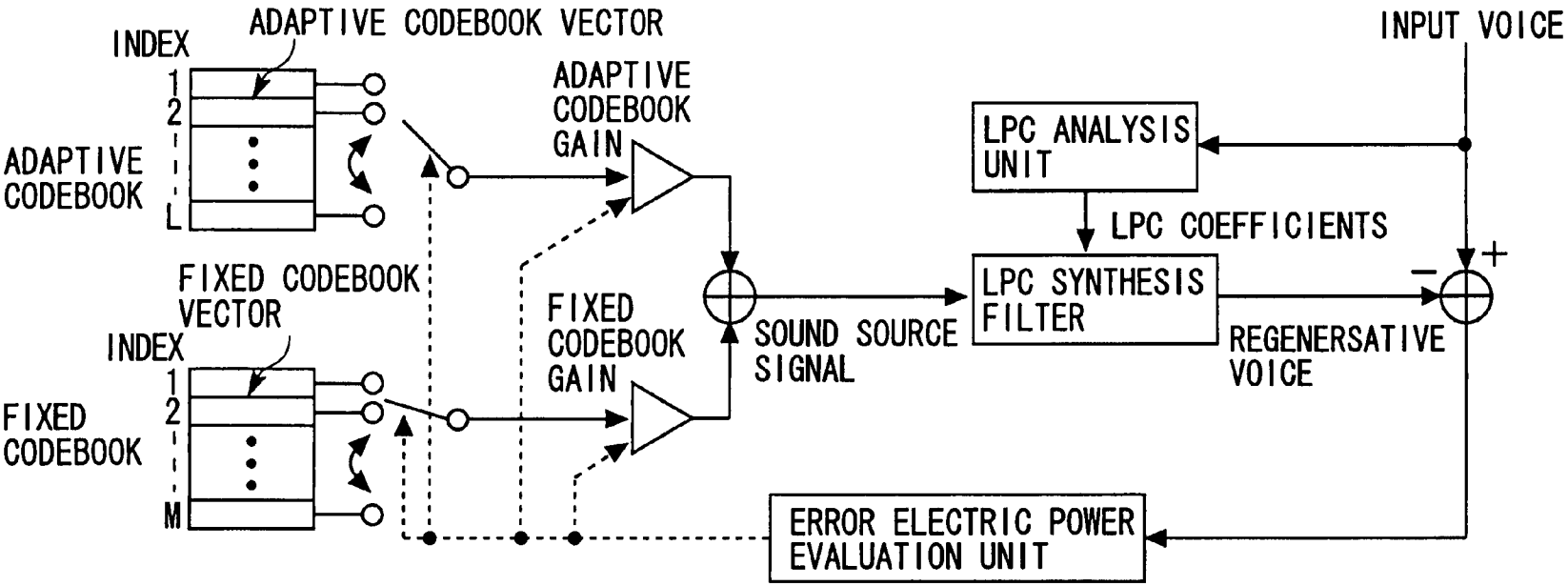
FIGS. 21A and 21B are block diagrams of an encoder based on the CELP method.
Figure 21B:
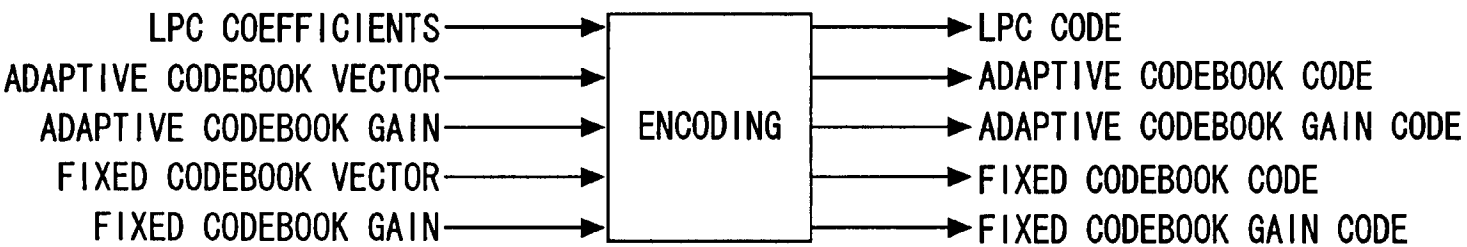

FIG. 21A is a block diagram showing an example of a configuration of the encoder based on the CELP method, and FIG. 21B is a diagram useful in explaining the encoding. In the CELP method, the input voice is encoded in frames each having a fixed length. First of all, the LPC coefficients are obtained from the input voice on the basis of the LPC analysis (Linear Predictor analysis). These LPC coefficients are filter coefficients when the vocal tract characteristics are approximated using an all poll type linear filter. Next, the sound source signal is extracted. An AbS (Analysis by Synthesis) technique is used for the extraction of the sound source signal.

In the CELP method, the sound source signal is inputted to the LPC synthetic filter having the LPC coefficients to thereby reproduce a voice. Consequently, a combination of the codebooks with which an error between a sound source candidate and an input voice becomes minimum when the parameters are synthesized through the LPC synthetic filter to obtain a voice is searched for from the sound source candidates constituted by a plurality of ACB vectors stored in the adaptive codebook, a plurality of SCB vectors stored in the fixed codebook, and the gains of both the vectors to extract the ACB vector, the SCB vector, the ACB gain, and the SCB gain. The parameters extracted through the above operation are encoded to obtain the LPC code, the ACB code, the SCB code, the ACB gain code, and the SCB gain code. A plurality of resultant codes are multiplexed to be transmitted in the form of a speech code to the decoder side.

Figure 22:
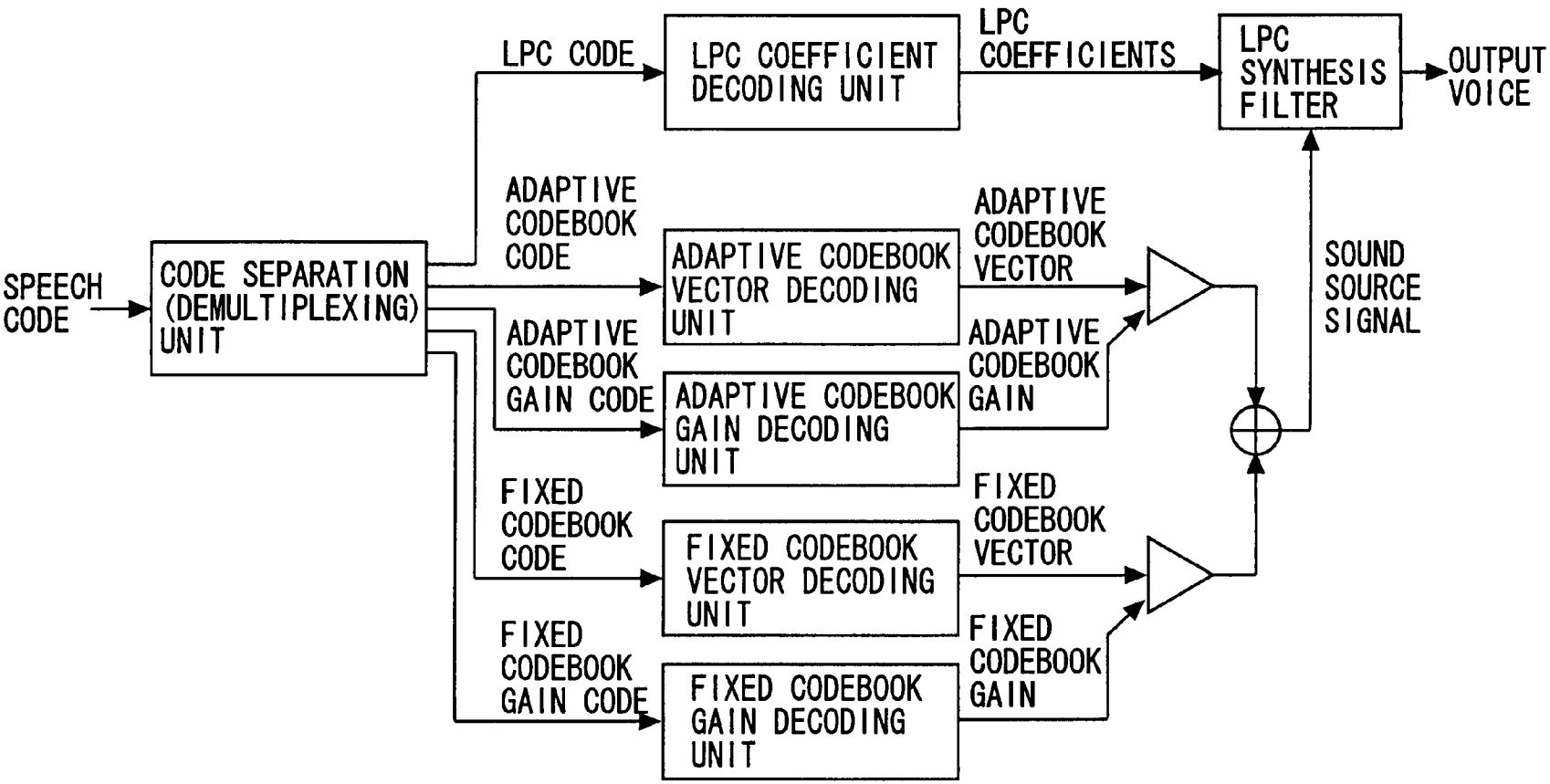
FIG. 22 is a block diagram of a decoder based on the CELP method.

FIG. 22 is a block diagram showing an example of a configuration of the decoder based on the CELP method. In the decoder, the speech code transmitted to the decoder is separated into the parameter codes (the LPC code, the ACB code, the SCB code, the ACB gain code, and the SCB gain code). Next, the ACB code, the SCB code, the ACB gain code, and the SCB gain code are decoded to generate a sound source signal. Then, the sound source signal is inputted to the LPC synthesis filter having the LPC coefficients obtained by decoding the LPC code to reproduce and output a voice.

<<Data Embedding Technique>>

Figure 1:
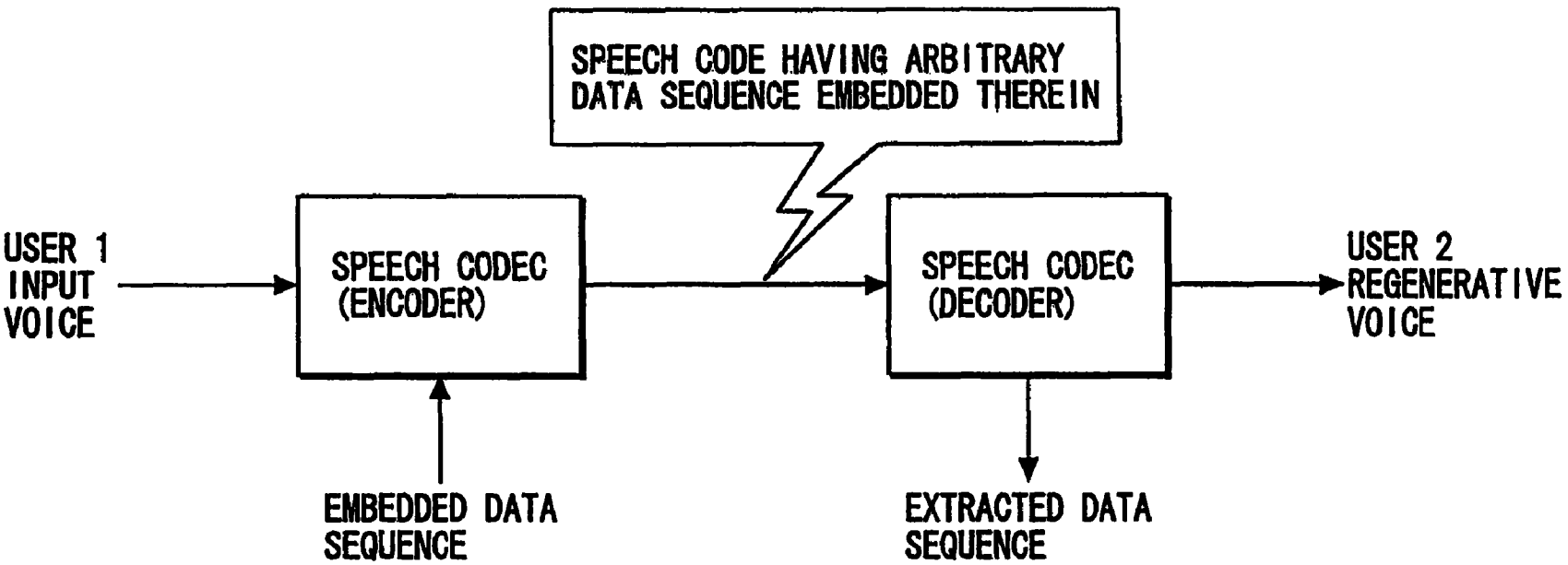
FIG. 1 is a diagram showing a speech encoding method to which a data embedding technique is applied.

As described above, in recent years, "a data embedding technique" for embedding arbitrary data in a digital data sequence of multi-media contents or the like such as an image, or a voice has attracted public attention. The data embedding technique is a technique for embedding different arbitrary information in multi-media contents themselves without exerting any of influences on quality by utilizing the property of sense perception of a human being. The data embedding technique is as described with reference to FIG. 1.

As one of the data embedding techniques, there is the above-mentioned basic technique (Japanese Patent Application No. 2002-26958). In the basic technique, the embedding and extraction of data are carried out on the transmission parameters contained in a speech code. FIG. 23 shows a flow of the processing for embedding and extracting data in the basic technique when the fixed codebook is made an object for the embedding. In the basic technique, data is embedded in the parameter codes outputted from the CELP encoder. Thereafter, the parameter codes are multiplexed to be transmitted in the form of a speech code having the data embedded therein to the CELP decoder side. On the CELP decoder side, the speech code transmitted to the CELP decoder is separated into the encoded parameters, and the embedded data is extracted in the extraction processing unit. Thereafter, the parameter codes are inputted to the CELP decoder to be decoded in order to reproduce a voice.

As described above, the transmission parameters encoded in accordance with the CELP method correspond to feature parameters of a voice generation system. Paying attention to this feature, states of the parameters can be grasped. Paying attention to two kinds of codes of the sound source signal, i.e., the adaptive codebook vector corresponding to the pitch sound source, and a fixed codebook vector corresponding to the noise sound source, these gains can be regarded as factors exhibiting the degree of contribution of the codebook vectors, respectively. In other words, if the gain is small, then the degree of contribution of the corresponding codebook vector becomes small. Then, the gain is defined as a judgment parameter. When the gain becomes equal to or lower than a certain threshold, it is judged that the degree of contribution of the corresponding sound source codebook vector is small to replace a code of the sound source codebook vector with an arbitrary sequence to thereby embed data. As a result, arbitrary data can be embedded while an influence on voice quality due to the data replacement is suppressed to a small level.

FIGS. 24A to 24C, and FIGS. 25A to 25C are conceptual diagrams useful in explaining the processing for embedding and extracting data when assuming that the judgment parameter is the fixed codebook gain, and the embedding parameter is the fixed codebook code. The embedding processing, as shown in FIGS. 24A to 24C, is executed by replacing the parameter code as an object for the embedding with an arbitrary data sequence when the judgment parameter is equal to or lower than a threshold.

On the other hand, as shown in FIGS. 25A to 25C, the data extraction processing, conversely to the embedding processing, is executed by cutting down an embedding object parameter when the judgment parameter is equal to or lower than a threshold. Here, as a threshold for the judgment parameter, the same threshold is used for the embedding side and the extraction side. That is to say, the same parameter and the same threshold are used for the embedding judgment and the extraction judgment. As a result, the embedding processing and the extraction processing are usually executed synchronously with each other.

As described above, in accordance with the basic technique, arbitrary data can be embedded without changing the encoding format of CELP. In other words, copyright information, ID information or other media information can be embedded in the voice information to be transmitted/stored without injuring compatibility essential to the application of communication/storage, and without being known to any of users. In addition, embedding/extraction control is performed using the parameters common to the CELP method such as the gain, and the adaptive/fixed codebook code. For this reason, the basic technique can be applied to various kinds of methods without being limited to a specific method.

Now, in the data embedding and extraction method based on the basic technique, the parameters, the judgment threshold, and the data embedding object parameters used for the judgment on the speech code to be transmitted are previously defined in both the transmission side and the reception side. Then, the embedding and the extraction of data are carried out using the same threshold and the same judgment parameters on the transmission side and the reception side. In other words, it is the absolute condition that the transmission parameters are synchronized with each other (i.e., in the same state) between the transmission side and the reception side.

However, when an error (a bit error or frame disappearance) is inserted into a speech code in a transmission line, the synchronous state cannot be held, and hence the embedded data cannot be properly extracted on the reception side. In particular, in the encoding method in which a state of a past frame exerts an influence on a current frame as in the CELP method, the transmission parameters are not returned back to the normal values for some time (for about several frames to about several tens of frames).

Consequently, it becomes difficult to accurately judge whether or not data was embedded in the speech code received for that period of time to extract the data. In addition, even if the speech code can be received, there is a possibility that an error is contained in the embedded data.

As for the speech encoding method, in order to prevent the voice quality from being extremely degraded, an error concealment technique is applied to such a transmission path. However, with such an error concealment technique, current parameters are generated by utilizing past parameters or the like, and hence the lost parameters cannot be restored to their former state. In other words, for the embedded data, an error in the speech code becomes a serious problem. In particular, when it is required that data on the transmission side perfectly agrees with the data on the reception side (as in ID information or the like for example), the influence is large.

As for the means for solving the above-mentioned problems, a method is conceivable in which an error detection signal is added to embedded data, and when an error is detected in a reception side, a transmission side is requested to resend data to thereby surely transmit and receive data. When, for example, the number of bits as an object for embedding is M bits per frame, data is embedded in N bits out of M bits, and an error detection signal is embedded in the remaining (M−N) bits (M and N are natural numbers). As a result, the presence or absence of an error in the embedded data can be detected on the reception side. Then, when an error is detected, the transmission side is requested to resend data in accordance with a method including embedding a predetermined resending command in a speech code to send the resultant code to the transmission side. In such a manner, an error detection function is added, and when an error is detected, resending of data is carried out, whereby it is expected that the embedded data is surely transmitted and received.

Note that, there is known a technique for using a sequence number, a check sum, or a CRC (Cyclic Redundancy Check) code as an error detection signal. These error detection algorithms will hereinbelow be described in brief.

<<Sequence Number>>

When the sequence number is applied, continuous numbers 0, 1, 2, 3 . . . are added to data blocks on the transmission side, respectively, and these numbers are checked on the reception side to thereby check on the continuity of the data. For example, when the sequence numbers are received in the order of 0, 1, 2, 4 it is understood that the data block having the sequence number 3 added thereto disappeared.

However, with the check made on the basis of the sequence numbers, an error occurring in a part of bits within the data blocks cannot be checked. In addition, when x bits (x is a natural number) are assigned to a sequence number, disappearance of the continuous blocks the number of which is smaller than $2^x$ can be detected. However, disappearance of the continuous blocks the number of which is equal to or larger than $2^x$ blocks cannot be surely detected. The reason for this will hereinbelow be described with reference to FIGS. 26A to 26C.

Now, it is supposed that 2 bits are secured in each of sequence numbers, and the sequence numbers are changed in order of 00→01→10→11→00 . . . . In addition, a netted data block exhibits a disappeared block. At this time, as shown in FIG. 26A, when the number of disappeared blocks is smaller than four, disappearance of a block can be detected on the basis of discontinuity of a change of the sequence numbers to specify the disappeared block. For example, in the case of FIG. 26A, the block of "01" disappeared. For this reason, the sequence numbers which should be changed in the order of 00→01→10 . . . are actually changed in the order of 00→10→ . . . . As a result, it is understood that the block of "01" disappeared.

However, when the number of disappeared blocks is four as shown in FIG. 26B, the continuity of a change of the sequence is held. For this reason, it is impossible to detect that four blocks disappeared.

Furthermore, if it is supposed that the number of disappeared blocks is equal to or larger than five, since a change of the sequence numbers becomes discontinuous as long as the number of disappeared blocks is not integral multiple of $2^x$, it is possible to detect that the blocks disappeared. However, referring to FIG. 26C, the sequence numbers are changed in the order of 00→10 which is completely similar to the case of FIG. 26A. That is to say, though five blocks actually disappeared, there is a possibility that it is judged that only one block disappeared. In order to solve this problem, it is effective to assign as much bits as possible to each of the sequence numbers. In this case, however, the number of bits assigned to the data body becomes less to reduce a data transfer rate.

<<Check Sum>>

The check sum is obtained such that data within a block is divided into every bit, and each bit, which is regarded as a numeric value, is summed up. For example, in a case where there is data of 4 bits of "1011", a check sum becomes 3 from calculation of 1+0+1+1=3. On the transmission side, this check sum is added to data to transmit the resultant data. On the reception side, the check sum sent to the reception side and the check sum calculated from the data are compared with each other to check on the presence or absence of an error. In a case where for example, the most significant bit of the 4 bits in the above-mentioned example is inverted from "1" to "0" due to an transmission line error (i.e., the 4 bits become "0011"), the check sum sent to the reception side is "3", where as the check sum calculated on the reception side becomes "2". Consequently, it is possible to detect that an error occurred in a transmission line.

However, in the case of the check sum, as described above, while an error of a part of data can be checked, disappearance of a data block itself cannot be detected.

Moreover, the check sum has frailty in that there is a possibility that an error of bits equal to or larger than 2 bits cannot be detected. More specifically, in a case where the number of bits each inverted from "0" to "1" due to the bit error and the number of bits each inverted from "1" to "0" due to a bit error are equal to each other, no error can be detected. For example, in a case where the uppermost 2 bits of data of 4 bits of "1011" is changed into "0111" due to a transmission line error, the check sum calculated on the reception side becomes "3". In this case, though errors occur in the bits, both the check sums become equal to each other. Consequently, no error can be detected.

<<CRC Code>>

A CRC is an error detection algorithm using a predetermined polynomial called a generating function. More specifically, when a data polynomial is assigned P (x), a generating function is assigned G(x), and a maximum degree of the generating function is assigned n, a CRC code is defined as the surplus of $P(x)\cdot x^n/G(x)$. So, the CRC code becomes a polynomial a degree of which is smaller than that of the generating function by one. Note that, an exclusive OR is used in subtraction generated when division is carried out in this case. The transmission side adds a CRC code to data to transmit the resultant data. On the reception side, a CRC code is calculated using the data sent to the reception side and the generating function to be compared with the CRC code sent to the reception side. In such a manner, the presence or absence of an error is checked on. One example of calculation of a CRC code will hereinbelow be shown.

Now, if data is given in the form of "1011", then a polynomial P(x) of the data is expressed by $P(x)=x^3+x+1$. If $G(x)=x^3+1$ is given as a generating function G(x), then the CRC code is expressed in the form of "010" from calculation of $P(x)\cdot x^n/G(x)=(x^3+x+1)\cdot x^3/(x^3+1)=x^3+x$ and the surplus of x. Then, this CRC code C(x) is added to the data to transmit the resultant data.

On the reception side, similarly to the transmission side, the CRC code is obtained from the data sent to the reception side, to be compared with C(x) in order to check on the presence or absence of an error. For example, when a transmission line error occurs during the transmission of the data so that the data having the most significant bit inverted (i.e., "0011") is received, the CRC code calculated on the reception side becomes "011" from calculation of $P'(x)\cdot x^n/G(x)=(x+1)x^3/(x^3+1)=x+1$ and the surplus of (x+1). Thus, the calculated CRC code differs from the CRC code sent to the reception side. As a result, it is possible to detect that an error occurred in the transmission line. Like wise, if the CRC code having the inverted upper most 2 bits ("0111") unable to be detected on the basis of the check sum is obtained, then the CRC code becomes "111" from calculation of $P'(x)\cdot x^n/G(x)=(x^2+x+1)\cdot x^3/(x^3+1)=x^2+x+1$ and the surplus of $(x^2+x+1)$. In this case as well, the calculated CRC code differs from the CRC code sent to the reception side. As a result, an error can be detected.

From the foregoing, in the case of the CRC code, it is possible to detect an error of bits equal to or larger than 2 bits which may not be detected on the basis of the check sum. More specifically, when a degree of a generating function is n, if an error concerned is an error of bits smaller than n bits, then this error can be surely detected. However, in other words, to increase the number of detectable error bits, it is necessary to increase the number of bits assigned to the CRC code. In this case, the number of bits assigned to the CRC code is also increased to increase the number of bits assigned to a block part other than a data body. For this reason, though the error resistance is enhanced, the data transfer rate is reduced. Moreover, in the case of the CRC code, similarly to the case of the check sum, when data blocks themselves disappeared, no error can be detected.

From the foregoing, for accurate detection of an error, it is considered to be necessary to use a block disappearance detection algorithm such as a sequence number, and bit error detection algorithm such as a CRC code at the same time. However, in this case, it is necessary to assign many bits to an error detection signal.

Figure 27:
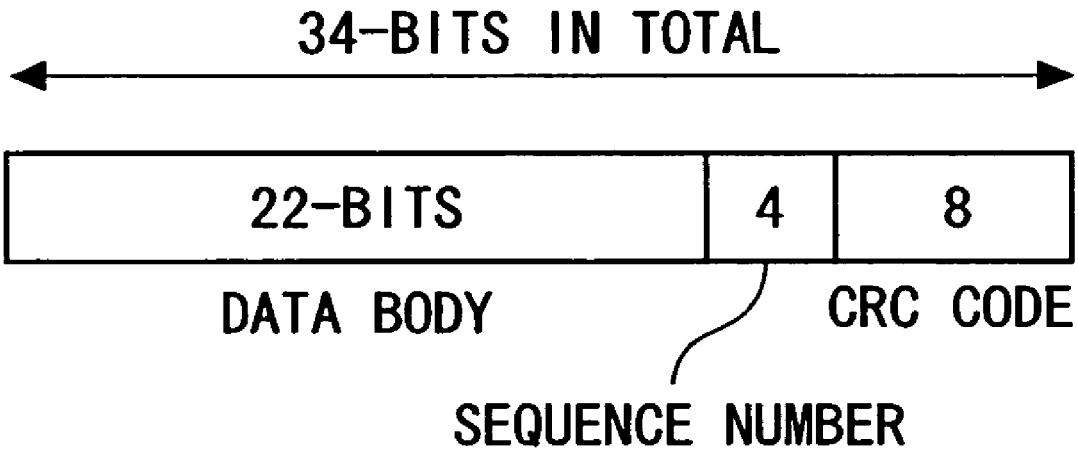
FIG. 27 is a diagram showing an example when an error detection signal is added to each frame.

For example, it is supposed that data is embedded in a fixed codebook 34 bits per frame conforming to the ITU-T G.729 encoding method. At this time, when as shown in FIG. 27, a sequence number of 4 bits, and a CRC code of 8 bits are assigned as an error detection signal, disappearance of continuous frames smaller than 16 frames, and an error of bits smaller than 8 bits can be detected. However, in this case, the number of bits assigned to the embedded data body becomes so less as to be 22 bits, and as a result, a data transfer rate is reduced by about 35% as compared with the case of no error detection.

In the light of this problem, in a case where in order to increase the number of bits assigned to the data body, the error detection signal is set so as to contain a sequence number of 1 bit, a parity bit (check sum of 1 bit) and the like, the data transfer rate is improved. However, since it is impossible to cope with disappearance of continuous two or more frames, and an error of two or more bits in some cases, the ability to detect an error is weakened.

As described above, the error detection ability and the data transfer rate show the tradeoff relationship, and hence it is difficult to enhance the error detection ability while maintaining the data transfer rate.

In the light of the foregoing, it is an object of the second invention to provide a technique which is capable of obtaining accurate embedded data on a data transmission side. In addition, the second invention aims at enhancing error detection ability without reducing a data transfer rate.

<Summary of Second Invention>

Next, a summary of the second invention will be described. The feature of the second invention is that as means for enhancing an error detection ability while maintaining a data transfer rate, embedded data and an error detection signal constitute a data block larger than the number of bits in which data can be embedded in one frame (hereinafter referred to as a large block (second data block)), and the large block is divided into "small blocks (first data blocks)" so as to meet an embedding size for each frame to be transmitted and received.

Figure 28A:
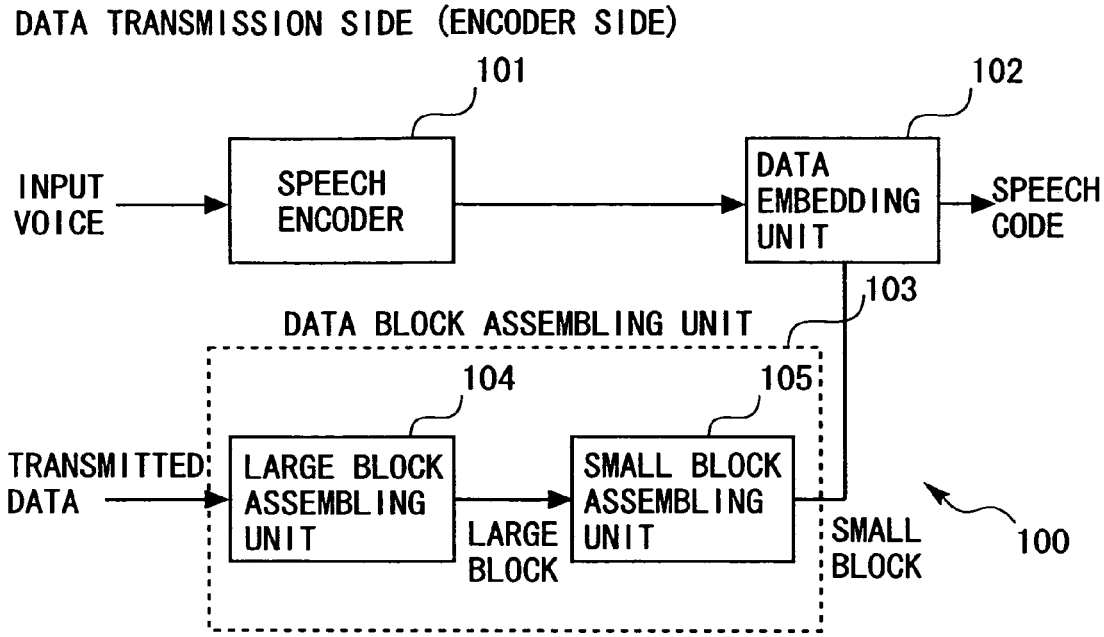
FIGS. 28A and 28B are diagrams showing the principles of a second invention.
Figure 28B:
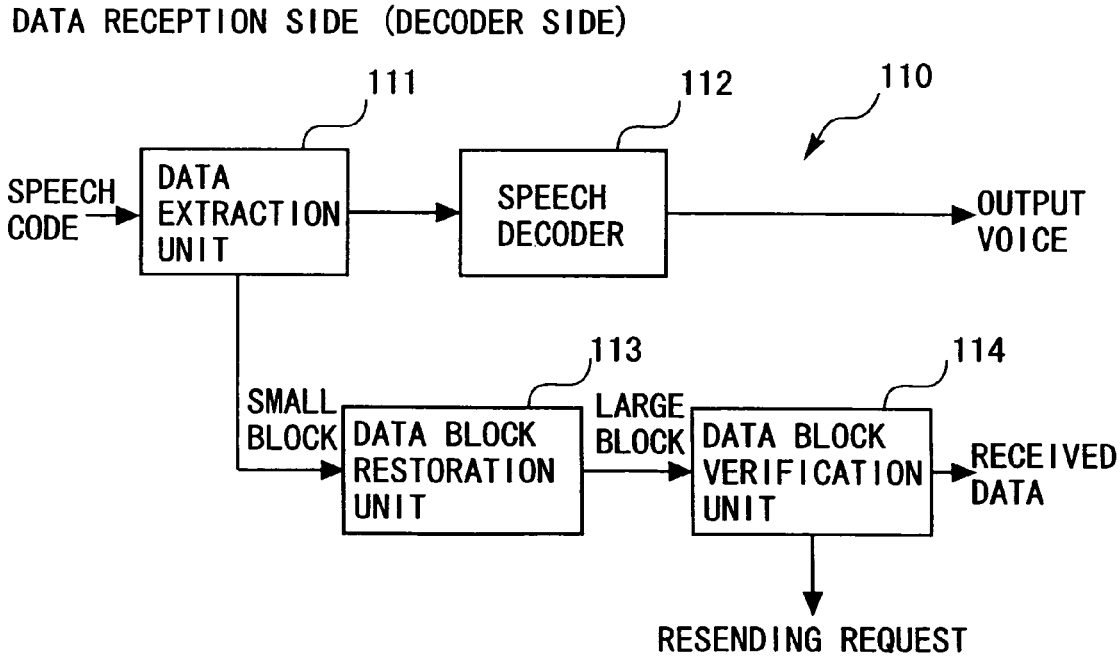
Figures 29A, 29B, 29C, 29D:
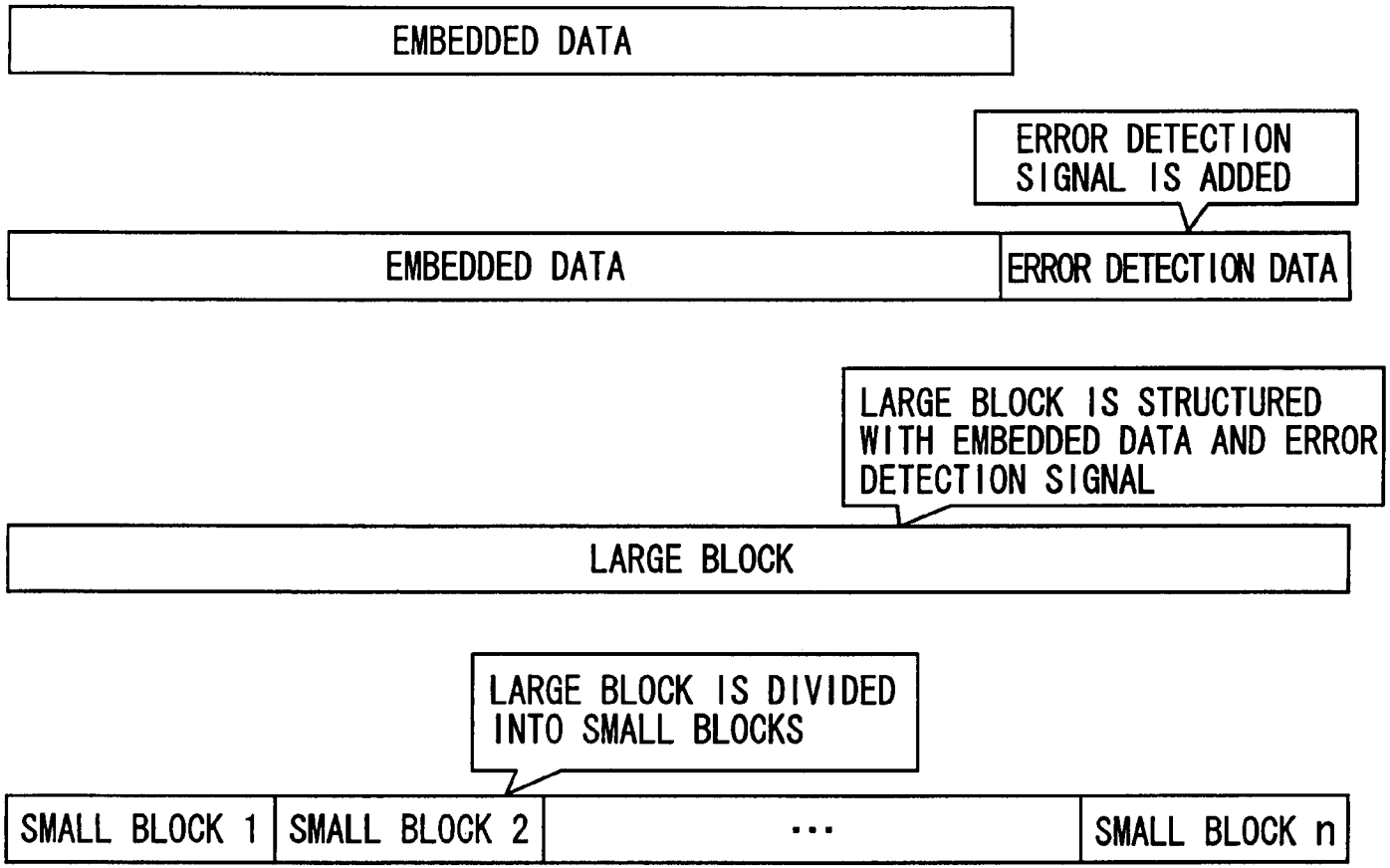
FIGS. 29A to 29D are diagrams useful in explaining a method including structuring a large block and small-blocks in the second invention.

The principles of the second invention are shown in FIGS. 28A and 28B. Processes will hereinbelow be described. FIG. 28A shows the principles of a data transmission side (encoder 100 side), and FIG. 28B shows the principles of a data reception side (decoder 110 side).

As shown in FIG. 28A, the encoder 100 (corresponding to data transmission device and data embedding device) includes a voice (speech) encoder 101, a data embedding unit 102 (corresponding to embedding unit), and a data block assembling unit 103. The data block assembling unit 103 includes a large block assembling unit 104, and a small block assembling unit 105.

The speech encoder 101 encodes an inputted voice to deliver the resultant speech code to the data embedding unit.

Transmission data (a data sequence as an object for embedding) is inputted to the data block assembling unit 103. The large block assembling unit 104 generates a large block from the transmission data to input the large block thus generated to the small block assembling unit 105. Then, the small block assembling unit 105 generates a plurality of small blocks from the large block to send the small blocks thus generated to the data embedding unit 102.

FIGS. 29A to 29D are diagrams useful in explaining a method including structuring a large block and a small block. As shown in FIGS. 29A to 29D, the large block assembling unit 104 generates a large block having an error detection signal added to embedded data as transmission data to deliver the large block thus generated to the small block assembling unit 105. The small block assembling unit 105 divides the large block into a predetermined number of small blocks 1 to n (n is a natural number) corresponding to one frame to generate a plurality of small blocks.

The data embedding unit 102 embeds each small block from the data block assembling unit 103 in a speech code for one frame to transmit the resultant code in the form of a speech code having data embedded therein.

As shown in FIG. 28B, the decoder 110 (corresponding to data reception device and data extraction device) includes a data extraction unit 111 (corresponding to extraction unit), a voice (speech) decoder 112, a data block restoration unit 113 (corresponding to restoration unit), and a data block verification unit 114 (corresponding to checking unit).

The speech code transmitted from the encoder side is inputted to the data extraction unit 111. Then, the data extraction unit 111 extracts the small blocks from the speech code to send the small blocks thus extracted to the data block restoration unit 113 and to deliver the speech code to the voice decoder 112.

Then, the voice decoder 112 executes a processing for decoding the speech code and a processing for reproducing a voice to output a voice.

The data block restoration unit 113 stores, therein the small blocks sent from the data extraction unit 111, and at the time when a plurality of small blocks required to restore the large block have been collected, restores the large block from these small blocks to send the large block thus restored to the data block verification unit 114.

Figures 30A, 30B, 30C:
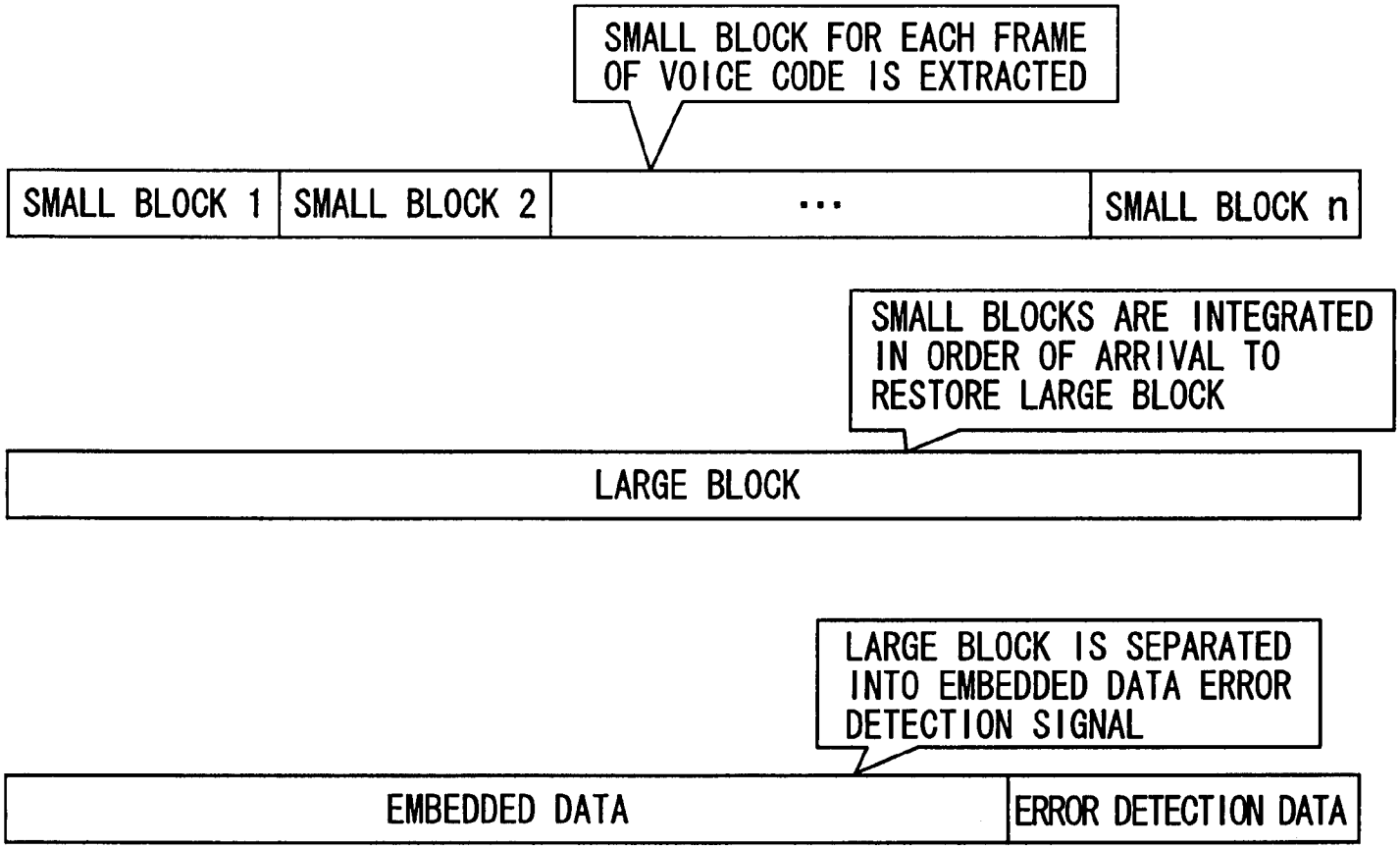
FIGS. 30A to 30C are diagrams useful in explaining a method including restoring a large block in the second invention.

FIGS. 30A to 30C are diagrams useful in explaining a method including restoring a large block. The data block restoration unit 113, for example, integrates a plurality of small blocks 1 to n from which a large block is to be structured in the order of arrival at the unit 113 for example to thereby restore a large block. But, the data block restoration unit 113 may be configured so as to restore a large block having the same contents as those before the large block was divided into a plurality of small blocks regardless of reception order of the small blocks.

The data block verification unit 114 separates a large block into embedded data and an error detection signal to check on the presence or absence of an error using the error detection signal. At this time, the data block verification unit 114, when it is judged as a result of the check that there is no error, outputs an embedded data portion in the large block in the form of reception data, and when it is judged as a result of the check that there is an error, abandons the large block to request the transmission side to resend the data.

In such a manner, a large block and small blocks are used, whereby even if the error detection signal having high error detection ability (i.e., requiring a large number of bits) is added, a ratio of the error detection signal to all the data blocks becomes small. Consequently, it becomes possible to suppress reduction of a data transfer rate.

Embodiments

Embodiments of the second invention will hereinafter be described with reference to the drawings. Configurations of the embodiments are merely exemplifications, and hence the second invention is not intended to be limited to the configurations of the embodiments.

Embodiment 1

Figure 31:
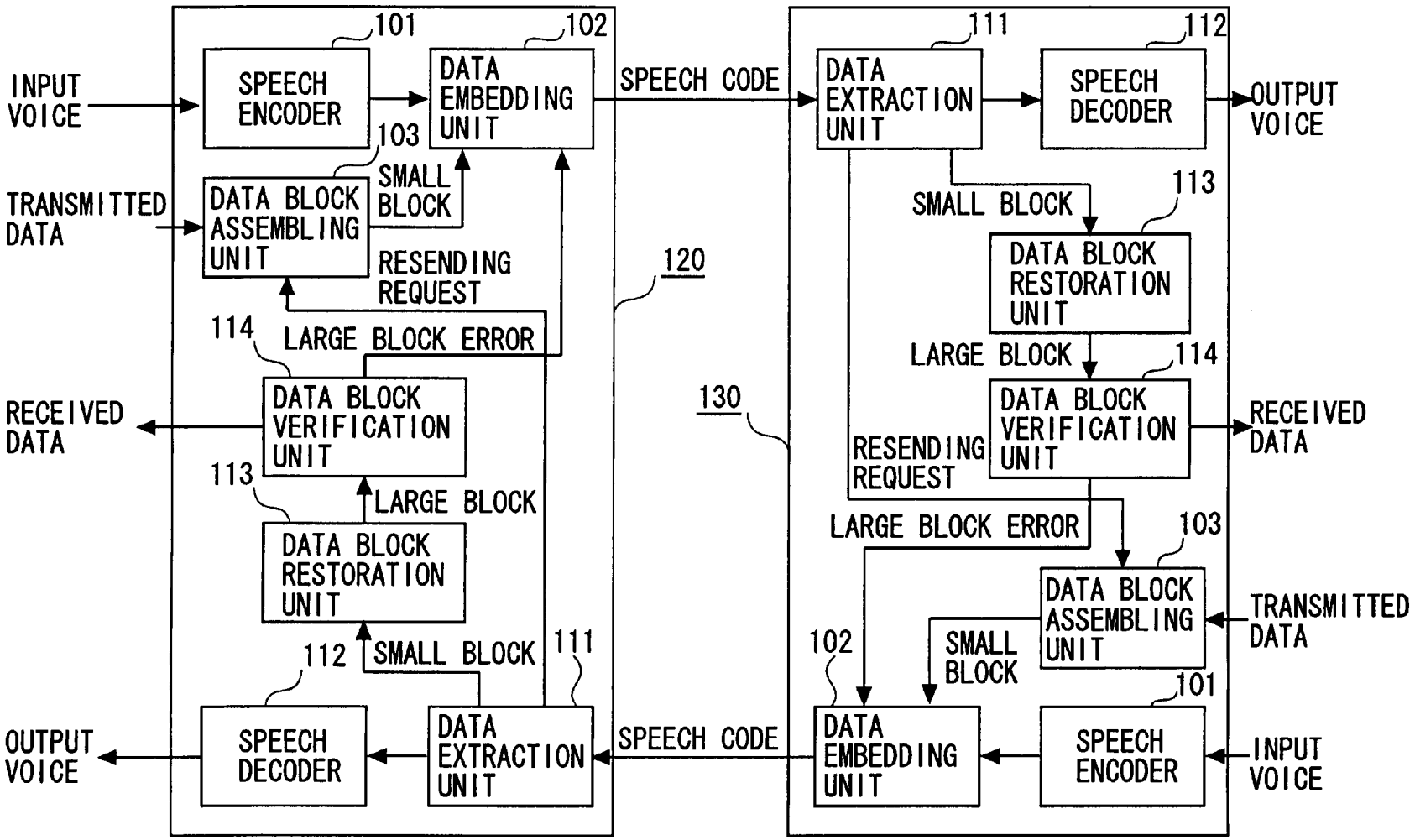
FIG. 31 is a diagram of a configuration in an embodiment 1 of the second invention.
Figures 32A, 32B, 32C, 32D:
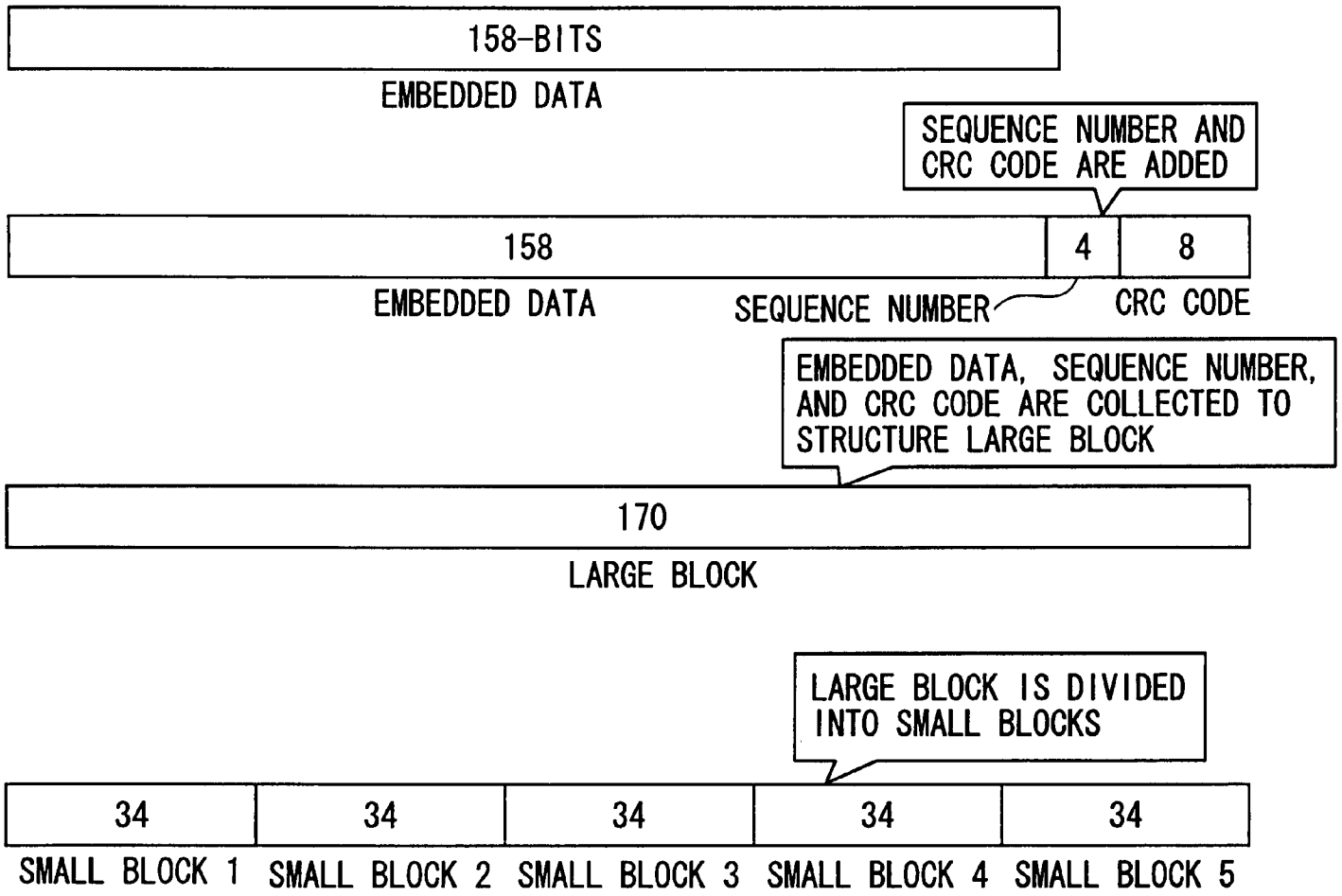
FIGS. 32A to 32D are diagrams useful in explaining a method including structuring a large block and small blocks in the embodiment 1 of the second invention.

As a specific method including implementing the second invention, an example in which the second invention is applied to the G.729 encoding method will hereinbelow be described. FIG. 31 shows a diagram of a configuration of an embodiment 1, and FIG. 32 shows one example of a structure of a data block in the embodiment 1. Processes will hereinbelow be described in detail.

Note that, as a parameter as an object for embedding in the embodiment 1, only the fixed codebook of 34 bits per frame is handled. But, in the second invention, the embedding object parameter is not intended to be limited to only the fixed codebook code. Hence, any other parameter such as an adaptive codebook code may be made an object for embedding, or a plurality of parameters may also be regulated as an embedding object.

Voice (speech) CODECs 120 and 130 (corresponding to data extraction device and communication device having transmission and reception unit) according to the embodiment 1 are shown in FIG. 31. The voice CODECs 120 and 130 have the same a configuration, and each of them also has a configuration as the encoder 100 and the decoder 110 as shown in FIGS. 28A and 28B. That is to say, each of the voice CODECs 120 and 130 includes a speech encoder 101, a data embedding unit 102, a data block assembling (combining) unit 103, a data extraction unit 111, a voice decoder 112, a data block restoration unit 113, and a data block verification unit (corresponding to checking unit and outputting unit) 114.

On a data transmission side (e.g., on a voice CODEC 120 side), the speech encoder 101 encodes an input voice. An encoding method is the same as a normal encoding method (a voice is encoded in accordance with the G.729 encoding method). The speech encoder 101 inputs a plurality of parameter codes (an LPC code, an adaptive codebook code, a fixed codebook code, an adaptive codebook gain code, and a fixed codebook gain code) obtained from the input voice to the data embedding unit 102.

The data block assembling unit 103, when the data extraction unit 111 receives a resending request (which will be described later), structures (assembles) a large block using data for which the resending request has been made, and when the data extraction unit 111 receives no resending request, extracts data from the transmission data to structure a large block. For this reason, the data block assembling unit 103A has a buffer for storing therein data for resending.

A method including structuring (assembling) a large block (distribution of bits to a data body and an error detection signal) may be optionally carried out. For example, as shown in FIGS. 32A to 32D, a large block is structured at bit distribution in which for 170 bits corresponding to the fixed codebook code for five frames, the data body takes 158 bits, a sequence number takes 4 bits, and a CRC code takes 8 bits. The data block assembling unit 103 divides a large block into five small blocks each having 34 bits for one frame to send the small blocks to the data embedding unit 102.

The data embedding unit 102 judges, for every frame, whether or not a frame concerned is a frame in which data can be embedded using the speech code parameters inputted from the speech encoder 101. Note that, the parameters used for the embedding judgment, and the judgment method are not limited. For example, as in the basic technique, there is adopted a configuration in which the fixed codebook gain is made a judgment parameter, and when the gain is equal to or lower than a threshold, data is embedded.

The data embedding unit 102, when it is judged that a frame concerned is a frame in which data can be embedded, replaces the fixed codebook code with a bit sequence constituting each small block to thereby embed data in a frame. Moreover, the data embedding unit 102 generates a speech code into which a plurality of parameter codes (containing the parameter codes which were replaced in a small block) are multiplexed to transmit the resultant speech code.

But, when a data error is detected in the data block verification unit 114 which will be described later, the data embedding unit 102 receives a large block error signal from the data block verification unit 114. In this case, the data embedding unit 102 gives a resending request priority, and replaces the fixed codebook code with a resending request signal of a large block to transmit the resultant signal. Note that, (a bit pattern of) a resending request signal is predetermined to be previously prepared in the data embedding unit 102.

Note that, the data embedding unit 102, when it is judged that a frame concerned is a frame in which data cannot be embedded, transmits the speech code having a plurality of parameter codes multiplexed thereinto sent from the speech encoder 101 to the data reception side without executing an embedding processing with respect to the frame concerned.

On a data reception side (e.g., on a voice CODEC 130 side), in the data extraction unit 111, the received speech code is separated into a plurality of parameter codes to judge whether or not data is embedded using at least one parameter code of these parameter codes. While the judgment parameters are not limited, the same judgment parameter and threshold as those on the data transmission side are used. In this embodiment, the fixed codebook gain is used as the judgment parameter, and when the fixed codebook gain is equal to or lower than a predetermined threshold, it is judged that data is embedded.

The data extraction unit 111, when it is judged that data is embedded, regards the fixed codebook code as embedded data (small block) to extract the data to send the data thus extracted to the data block restoration unit 113. But, the data extraction unit 111, when the extracted data is a resending request signal (exhibiting a bit pattern of the resending request), sends the resending request to the data block assembling unit 103 in order to resend the data. As a result, the data block assembling unit 103 delivers a plurality of small blocks constituting a large block corresponding to the resending request to the data embedding unit 102.

The data block restoration unit 113 stores small blocks sent from the data extraction unit 111, and at the time when a predetermined number of small blocks (five small blocks in this case) have been collected, arranges these small blocks in order of reception to restore a large block to send the large block thus restored to the data block verification unit 114.

The data block verification unit 114, on reception of the large block, separates the large block into embedded data (data body), a sequence number, and a CRC encoder to check on the presence or absence of an error on the basis of the sequence number and the CRC code. If it is judged as a result of the error check that there is no error, then the data block verification unit 114 outputs the data body in the form of received data. On the other hand, if it is judged as a result of the error check that there is an error, then the data block verification unit 114 abandons the large block (data body) and informs the data embedding unit 102 of that an error occurred in order to make a resending request. As a result, the data embedding unit 102 executes a processing for embedding a resending request signal so as to take precedence over a processing for embedding the small blocks sent from the data block assembling unit 103.

Note that, the data extraction unit 111 separates the inputted speech code into a plurality of parameter codes irrespective of extraction or non-extraction of data to input these parameter codes to the voice decoder 112. Then, the voice decoder 112 reproduces a voice by utilizing a normal decoding method on the basis of a plurality of parameter codes inputted to the voice decoder 112 to output the resultant voice (a voice is decoded and reproduced in accordance with the G.729 decoding method).

The above-mentioned operation is also applied to a case where the voice CODEC 130 is provided on the data transmission side, and the voice CODEC 120 is provided on the data reception side.

<<Operation and Effects of Embodiment 1>>

As described above, according to the embodiment 1, the error detection signal such as the sequence number and the CRC code is added to the embedded data, whereby it is possible to detect an error occurred in a transmission line or the like. Then, when an error occurred, the resending request is sent to the data transmission side in order to resend the data. As a result, it becomes possible to surely transmit and receive the data.

Moreover, the data block larger than one frame is structured to be divided for transmission, whereby it is possible to suppress reduction of a data transfer rate due to addition of the error detection signal, and it becomes possible to obtain a high error detection ability.

More specifically, when the sequence number of 4 bits, and the CRC code of 8 bits are added for every frame of 34 bits, as described above, the bits assigned to the data body become 22 bits. In this case, the data transfer rate is reduced by 35% as compared with a case where there is no error.

On the other hand, since in the embodiment 1, the sequence number of 4 bits and the CRC code of 8 bits are added to a large block containing five frames (=170 bits), 158 bits can be assigned to the data body. In other words, the data can be transmitted and received at a rate of 31.6 bits per frame on average. That is to say, it becomes possible to suppress reduction of a data transfer rate to about 7% as compared with the case of the data transfer rate of 34 bits/frame having no error detection.

Note that, while in the embodiment 1, the G.729 encoding method is used as the speech encoding method, the present invention is not intended to be limited to the G.729 encoding method, and hence can also be applied to a case where for example, the 3GPP AMR encoding method is used, and so forth.

Embodiment 2

Figure 33:
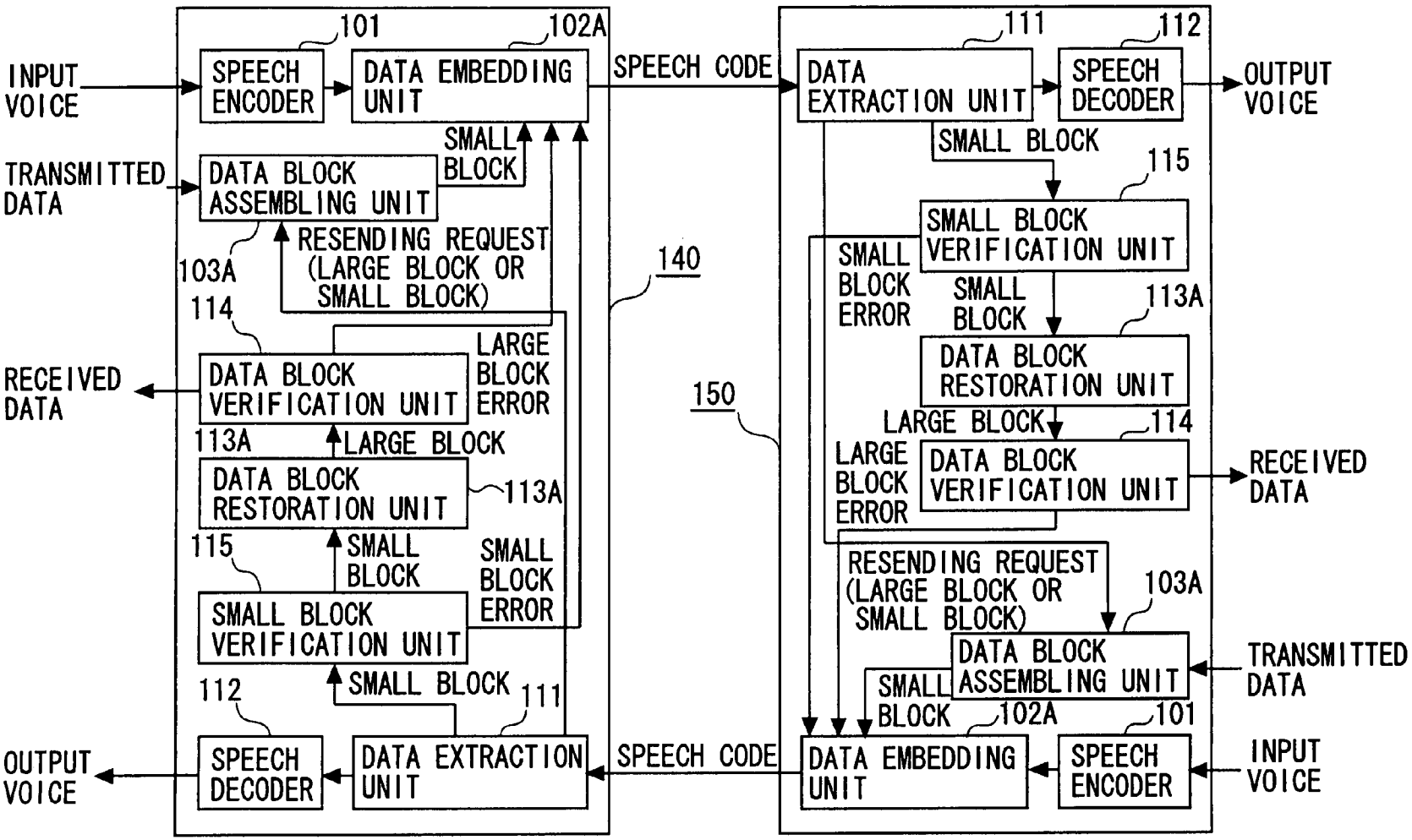
FIG. 33 is a diagram of a configuration in an embodiment 2 of the second invention.
Figures 34A, 34B, 34C, 34D:
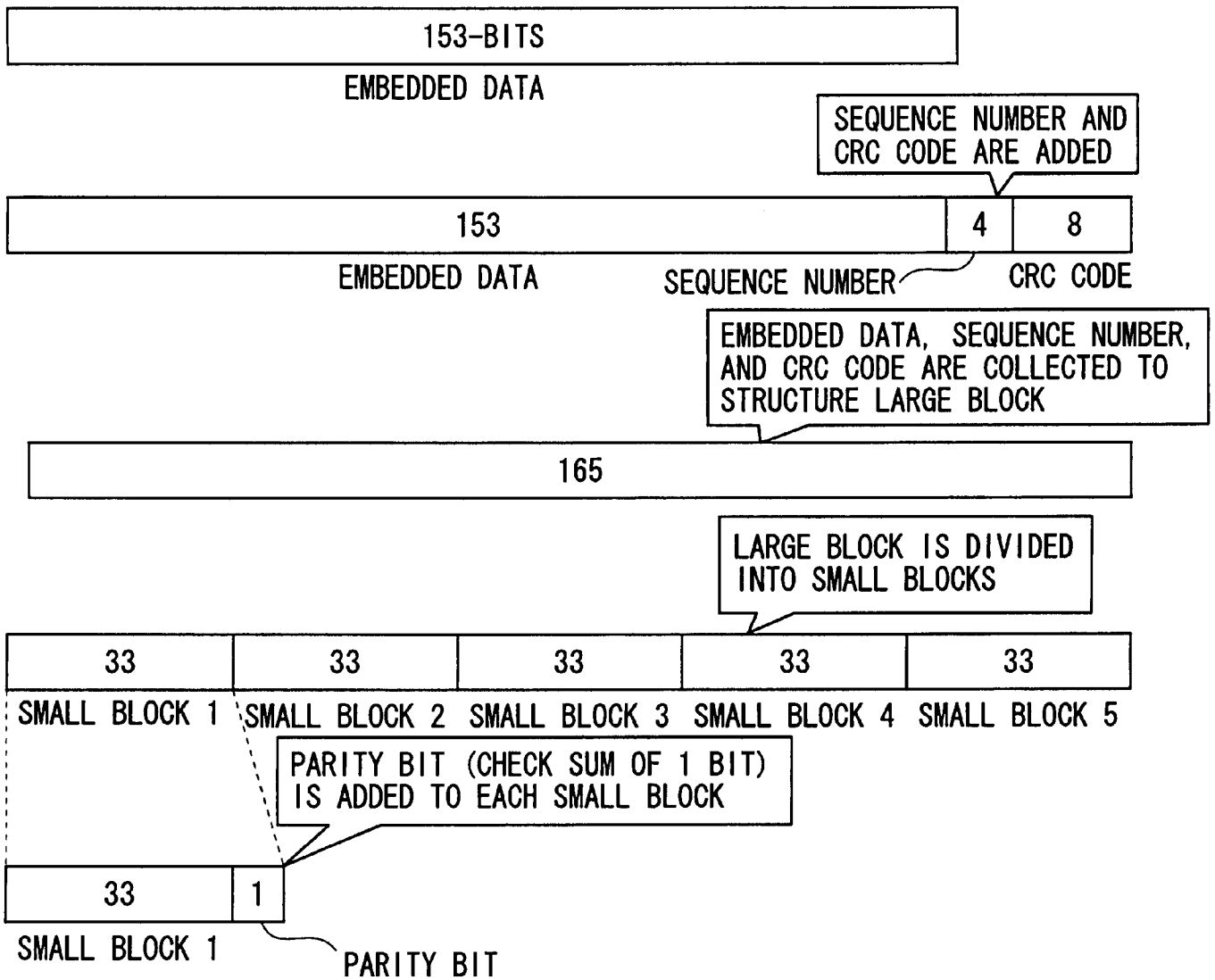
FIGS. 34A to 34D are diagrams useful in explaining a method including structuring a large block and small blocks in the embodiment 2 of the second invention.

FIG. 33 is a diagram showing an example of configurations of voice (speech) CODECs 140 and 150 (corresponding to data extraction device and communication device each having transmission and reception unit) according to an embodiment 2 of the second invention. The embodiment 2 is different from the embodiment 1 in that each of the voice CODECs 140 and 150 includes a data embedding unit 102A, a data block assembling (combining) unit 103A, and a data block restoration unit 113A instead of the data embedding unit 102, the data block assembling unit 103, and the data block restoration unit 113 in the embodiment 1 (FIG. 31), and a small block verification unit 115 is inserted between the data extraction unit 111 and the data block restoration unit 113A.

FIGS. 34A to 34E are diagrams useful in explaining a method including structuring data blocks (a large block and small blocks) in the embodiment 2. The data block assembling unit 103A in the embodiment 2 generates a large block of 165 bits from embedded data (data body) of 153 bits, a sequence number of 4 bits, and a CRC code of 8 bits. After the data block assembling unit 103A divides the large block into small blocks (each having 33 bits) for each frame, the data block assembling unit 103A adds a parity bit (a check sum of 1 bit) as a simple error detection signal to each small block. In the embodiment 2, each small block having such a parity bit added thereto is given to the data embedding unit 102A.

The data embedding unit 102A has the same configuration in the embodiment 1 with respect to the judgment for data embedding, and the operation for embedding data in a speech code in a small block. Moreover, the data embedding unit 102A is configured so as to receive a report of a small block error from the small block verification unit 115, and when receiving the small block error, embeds a resending request signal of a corresponding small block instead of the small block.

The small block verification unit 115 is configured so as to receive small blocks from the data extraction unit 111, and carries out parity check using the parity bit (check sum) added to a small block. At this time, if the check results are OK, then the small block verification unit 115 sends the small block concerned to the data block restoration unit 112, while if the check results are NG (error), then the small block verification unit 115 informs the data embedding unit 102A of a small block error.

The embodiment 2 is nearly equal in configuration to the embodiment 1 except for the above-mentioned respects. Note that, while in the embodiment 2, the parity bit for error detection for each small block is used, any other error detection algorithm may also be used. In addition, the number of bits of the error detection signal of a small block may not be 1 bit (the predetermined number of bits may be set). In addition, a plurality of error detection algorithms may be used together with one another for the error detection of a small block.

An operation of the embodiment 2 will hereinbelow be described. On a data transmission side (e.g., on a voice CODEC 140 side), the speech encoder 101 encodes an input voice. An encoding method is the same as a normal encoding method. The speech encoder 101 inputs a plurality of parameter codes (an LPC code, an adaptive codebook code, a fixed codebook code, an adaptive codebook gain code, and a fixed codebook gain code) obtained from the input voice to the data embedding unit 102A.

The data block assembling unit 103A structures a large block from transmission data inputted to the unit 103A itself. Here, a method including structuring a large block (bit distribution) is arbitrarily carried out. For example, as shown in FIGS. 34A to 34D, when the number of bits of a large block is regulated as 165 bits, the large block may be structured at a distribution rate in which the data body takes 153 bits, the sequence number takes 4 bits, and the CRC code takes 8 bits.

The data block assembling unit 103A divides the large block structured in such a manner into five blocks each having 33 bits, and adds a parity bit of 1 bit to each small block of 33 bits obtained through the division of the large block to structure five small blocks each having 34 bits for one frame of the speech code to send the small blocks to the data embedding unit 102A.

In addition, the data block assembling unit 103A is configured so as to receive a resending request for a large block, and a resending request for a small block from the data extraction unit 111. The data block assembling unit 103A, upon reception of the resending request for a large block, sends the small blocks (the large block to be resent) constituting the large block corresponding to that resending request to the data embedding unit 102A, and upon reception of the resending request for a small block, sends the small block (the small block to be resent) corresponding to that resending request to the data embedding unit 102A. For this reason, the data block assembling unit 103A has a buffer for storing therein data to be resent.

The data embedding unit 102A judges whether or not a frame concerned is a frame in which data can be embedded using the speech code parameters. Note that, the parameters used for the judgment and the judgment method are not limited. For example, there may be applied a method or the like in which as in the basic technique, the fixed codebook gain is set as a judgment parameter, and when the gain is equal to or lower than a threshold, data is embedded, and when the gain is higher than the threshold, no data is embedded.

The data embedding unit 102A, when it is judged that a frame concerned is a frame in which data can be embedded, replaces the fixed codebook code inputted from the speech encoder 101 with a small block from the data block assembling unit 103A. Then, the data embedding unit 102A generates a speech code into which a plurality of parameter codes is multiplexed to send the speech code thus generated to the data reception side. But, when a data error of a large block or a small block is detected in the data block verification unit 114 or in the small block verification unit 115, a resending request for a large block or a small block is given priority, and the fixed codebook is replaced with a corresponding resending request signal to transmit the resending request signal.

A bit pattern of each of the resending request signal for a large block and the resending request signal for a small block is predetermined. The resending request signal for a large block and the resending request signal for a small block may be structured so as to contain identification information for a large block and identification information for a small block, respectively.

On the other hand, the data embedding processing unit 102A, when it is judged that a frame concerned is a frame in which data cannot be embedded, does not execute a processing for embedding data in a speech code of the frame concerned, but generates a speech code with a plurality of parameter codes sent from the speech encoder 101 to transmit the speech code thus generated to the data reception side.

On a data reception side (e.g., a voice CODEC 150 side), the data extraction unit 111 receives the speech code to judge whether or not data is embedded using the received speech code parameter. While a judgment parameter is not limited, the same judgment parameter and threshold as those on the data transmission side are used. The data extraction unit 111, when it is judged that data is embedded, regards the fixed codebook code as data to send the fixed codebook code to the small block verification unit 115. But, the data extraction unit 111, when the extracted data is a resending request signal (for a large block or a small block), sends the resending request signal to the data block assembling unit 103A in order to resend the data.

The small block verification unit 115, upon reception of the small block, carries out error check by checking a parity bit. If it is judged as a result of the error check that there is no error, then the small block verification unit 115 transmits the small block to the data block restoration unit 113A. On the other hand, if it is judged as a result of the error check that there is an error, then the small block verification unit 115 abandons the small block and informs the data embedding unit 102A of that an error occurred in the small block in order to make a resending request.

The data block restoration unit 113A, at the time when a predetermined number of small blocks (five small blocks in this case) have been collected, restores a large block from the small blocks to send the large block thus restored to the data block verification unit 114. Here, the data block restoration unit 113A is configured so as to receive a small block error signal when a small block error is detected in the small block verification unit 115. In this case, the data block restoration unit 113A stops or leaves restoration of a large block over until a small block having an error occurred therein is resent to collect a plurality of small blocks from which the corresponding large block is to be restored.

The data verification unit 114 separates the large block sent from the data block restoration unit 113A into a data body, a sequence number, and a CRC code to check an error using the sequence number and the CRC code. If it is judged as a result of the error check that there is no error, then the data verification unit 114 outputs the data body in the form of received data. On the other hand, if it is judged as a result of the error check that there is an error, then the data verification unit 114 abandons the data and informs the data embedding unit 102A of that an error occurred in the large block in order to make a resending request.

Note that, the data extraction unit 111 separates the inputted speech code into a plurality of parameter codes irrespective of extraction or non-extraction of data to input these parameter codes to the voice decoder 112. Then, the voice decoder 112 reproduces a voice from a plurality of parameter codes inputted to the voice decoder 112 by utilizing a normal decoding method to output the regenerative voice (a voice is decoded and reproduced in accordance with the G.729 decoding method).

The above-mentioned operation is also applied to a case as well where the voice CODEC 150 is provided on the data transmission side, and the voice CODEC 140 is provided on the data reception side.

<<Operation and Effects of Embodiment 2>>

Since in the embodiment 1, when an error is actually detected, in which of small blocks an error occurred cannot be judged, it is necessary to resend all the small blocks constituting the large block. In other words, even if an error is so negligible as to be merely 1 bit, the data for five frames of the speech code 5 must be resent, and hence a resending penalty is large.

On the other hand, in the embodiment 2, a parity bit is added to each small block. As a result, the number of bits which can be assigned to the data body become smaller than that in the embodiment 1. However, if an error concerned is an error which is so negligible as to be 1 bit or the like per frame, only the small block concerned has to be resent, and hence it becomes possible to suppress the penalty when carrying out resending.

More specifically, in the embodiment 2, a sequence number of 4 bits, a CRC code of 8 bits, and a parity bit of 5 bits (1 bit×5 frames) are added to a large block having five frames of 170 bits. For this reason, 153 bits can be assigned to the data body. In other words, data can be transmitted and received at a rate of 30.6 bits/frame. That is to say, it is possible to suppress reduction of a transfer rate to 10% as compared with the transfer rate of 34 bits/frame when no error is detected. Moreover, in case or the like of a negligible error which can be detected on the basis of a parity bit, a resending penalty for an error can be suppressed as compared with the embodiment 1.

<Combination of First Invention and Second Invention>

The first invention and the second invention described above can be suitably combined with each other without departing from the respective objects of the first and second inventions. For example, the embedding judgment parameters and the embedding object parameters which were described in the first invention can be applied to the second invention. That is to say, the embedding processing unit and the extraction processing unit in the first invention can be incorporated in the data embedding unit and the data extraction unit in the second invention, respectively.

The present invention can be generally applied to a field to which a technique for data embedding and/or extraction is applied. For example, the invention can be applied in order that in a field of voice communication, data may be embedded in speech codes to be transmitted on an encoder side, and the data may be extracted from the speech codes on a decoder side.

In particular, the present invention can be applied to a speech encoding (compressing) technique which is applied to all domains such as a packet voice transmission system typified by a digital mobile wireless system or a VoIP (Voice over Internet Protocol), and has been greatly demanded and has become largely important as a digital watermarking or function expanded technique for embedding a copyright or ID information to enhance concealment of a call without exerting any of influences on a transmission bit sequence.

What is claimed is:

1. A data embedding device for embedding objective data to be embedded in a speech code obtained by encoding a speech in accordance with a speech encoding method based on a voice generation process of a human being, comprising:

an embedding judgment unit, for every speech code, which is outputted from a code excited linear prediction (CELP) encoder, to perform judgment processing to judge whether or not a speech code is capable of embedding data based on a liner spectrum pair (LSP) code, a pitch lag code, a fixed code and a gain code included in a past speech code outputted from the CELP encoder before output of the speech code;

an embedding unit to perform embedding processing to embed data to be embedded in a part of a LSP code, a pitch lag code and a fixed code, defined as embedding object parameter codes, among a speech code for which it is judged by the embedding judgment unit that a speech code is capable of embedding data, wherein the embedding unit replaces the embedding object parameter codes with the data to be embedded and the embedding unit performs the embedding processing with respect to the speech code, for which it is judged by the embedding judgment unit that the speech code is capable of embedding data, among speech codes which are outputted from the CELP encoder and pass through the embedding unit itself; and a unit to provide the embedding judgment unit with the speech codes passed through the embedding unit, wherein the embedding judgment unit uses at least one of the speech codes as the past speech code.

2. A data extraction device for extracting data embedded in a speech code, comprising:

a reception unit to receive speech codes including a speech code containing embedded data;

an extraction judgment unit to, for every speech code, which is received by the reception unit, judge whether or not data is being embedded in a speech code based on a liner spectrum pair (LSP) code, a pitch lag code, a fixed code and a gain code included in a past speech code, which is one of the speech codes received by the reception unit before reception of the speech code; and an extraction unit to extract data being embedded in a part of a LSP code, a pitch lag code and a fixed code among a speech code for which it is judged by the extraction judgment unit that data is being embedded.

3. A data embedding/extraction device for executing a process for embedding data in a speech code and a process for extracting embedded data from the speech code, comprising:

an embedding judgment unit to perform judgment processing, for every speech code, which is outputted from a code excited linear prediction (CELP) encoder, to judge whether or not a speech code is capable of embedding data based on a linear spectrum pair (LSP) code, a pitch lag code, a fixed code and a gain code included in a past speech code outputted from the CELP encoder before output of the speech code;

an embedding unit to perform embedding processing to embed data in a part of a LSP code, a pitch lag code and a fixed code, defined as embedding object parameter codes, among a speech code for which it is judged by the embedding judgment unit that a speech code is capable of embedding data, wherein the embedding unit replaces the embedding object parameter codes with the data to be embedded and the embedding unit performs the embedding processing with respect to the speech code, for which it is judged by the embedding judgment unit that the speech code is capable of embedding data, among speech codes which are outputted from the CELP encoder and pass through the embedding unit itself;

a unit to provide the embedding judgment unit with the speech codes passed through the embedding unit, wherein the embedding judgment unit uses at least one of the speech codes as the past speech code;

a reception unit to receive speech codes including a speech code containing embedded data;

an extraction judgment unit to, for every speech code, which is received by the reception unit, judge whether or not data is being embedded in a speech code based on a liner spectrum pair (LSP) code, a pitch lag code, a fixed code and a gain code included in a past speech code, which is one of the speech codes received by the reception unit before reception of the speech code; and an extraction unit to extract data being embedded in a part of a LSP code, a pitch lag code and a fixed code among a speech code for which it is judged by the extraction judgment unit that data is being embedded.

4. A data embedding method for embedding data in a speech code, comprising:

performing, for every speech code, which is outputted from a code excited liner prediction (CELP) encoder, judging processing to judge whether or not a speech code is capable of embedding data based on a linear spectrum pair (LSP) code, a pitch lag code, a fixed code and a gain code included in a past speech code outputted from the CELP encoder before output of the speech code;

performing embedding processing to embed data in a part of a LSP code, a pitch lag code and a fixed code, defined as embedding object parameter codes, among a speech code for which it is judged that a speech code is capable of embedding data, wherein the embedding includes replacing the embedding object parameter codes with the data to be embedded; and providing the judging processing with speech codes including a first speech code, which has been outputted from the CELP decoder and data have been embedded by the embedding processing and a second speech code, which has been outputted from the CELP decoder and no data have been embedded by the embedding processing, wherein the judging processing uses at least one of the speech codes as the past speech code.

5. A data extraction method for extracting embedded data from a speech code, comprising:

receiving speech codes including a speech code containing embedded data;

judging, for every speech code, which is received by the receiving, whether or not data is being embedded in a speech code based on a liner spectrum pair (LSP) code, a pitch lag code, a fixed code and a gain code included in a past speech code, which is one of the speech codes received by the receiving before reception of the speech code; and extracting data being embedded in a part of a LSP code, a pitch lag code and a fixed code, defined as embedding object parameter codes, among a speech code for which it is judged that data is being embedded.

6. A data embedding/extraction method with respect to a speech code obtained by encoding a speech in accordance with a speech encoding method based on a voice generation process of a human being, comprising:

performing, for every speech code, which is outputted from a code excited liner prediction (CELP) encoder, judging processing to judge whether or not a speech code is capable of embedding data based on a linear spectrum pair (LSP) code, a pitch lag code, a fixed code and a gain code included in a past speech code outputted from the CELP encoder before output of the speech code;

performing embedding processing to embed data in a part of a LSP code, a pitch lag code and a fixed code, defined as embedding object parameter codes, among a speech code for which it is judged that a speech code is capable of embedding data, wherein the embedding replaces the embedding object parameter codes with the data to be embedded and the embedding performs the embedding processing with respect to the speech code for which it is judged by the embedding judgment unit that the speech code is capable of embedding data among speech codes which is outputted from the CELP encoder and passes through the embedding unit itself;

providing the judging processing with speech codes including a first speech code, which has been outputted from the CELP decoder and data have been embedded by the embedding processing and a second speech code, which has been outputted from the CELP decoder and no data have been embedded by the embedding processing, wherein the judging processing uses at least one of the speech codes as the past speech code;

receiving speech codes including a speech code containing embedded data;

judging, for every speech code, which is received by the receiving, whether or not data is being embedded in a speech code based on a liner spectrum pair (LSP) code, a pitch lag code, a fixed code and a gain code included in a past speech code, which is one of the speech codes received by the receiving before reception of the speech code; and extracting data being embedded in a part of a LSP code, a pitch lag code and a fixed code among a speech code for which it is judged that data is being embedded.

* * * * *